US007824314B2

(12) United States Patent
Maresh et al.

(10) Patent No.: US 7,824,314 B2
(45) Date of Patent: Nov. 2, 2010

(54) ADJUSTABLE STRIDE LENGTH EXERCISE METHOD AND APPARATUS

(76) Inventors: Joseph D. Maresh, P.O. Box 645, West Linn, OR (US) 97068-0645; Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

(21) Appl. No.: 12/397,942

(22) Filed: Mar. 4, 2009

(65) Prior Publication Data

US 2009/0209395 A1 Aug. 20, 2009

Related U.S. Application Data

(63) Continuation-in-part of application No. 11/482,232, filed on Jun. 30, 2006, now Pat. No. 7,604,574, which is a continuation of application No. 09/065,308, filed on Apr. 23, 1998, now Pat. No. 7,086,993, application No. 12/397,942, which is a continuation-in-part of application No. 10/712,784, filed on Nov. 12, 2003, now Pat. No. 7,556,589, which is a continuation-in-part of application No. 09/684,667, filed on Oct. 6, 2000, now Pat. No. 6,672,994.

(51) Int. Cl.
*A63B 69/16* (2006.01)
*A63B 22/04* (2006.01)

(52) U.S. Cl. ..... 482/52; 482/57; 482/62

(58) Field of Classification Search ..... 482/51, 482/52, 57–65, 70, 71, 79, 1, 5, 8–9
See application file for complete search history.

(56) References Cited

U.S. PATENT DOCUMENTS 3,869,121 A * 3/1975 Flavell ..... 482/2
4,714,244 A 12/1987 Kolomayets et al.
4,776,583 A 10/1988 Jennings
4,934,694 A 6/1990 McIntosh
5,135,447 A 8/1992 Robards et al.
5,149,084 A 9/1992 Dalebout et al.
5,279,529 A 1/1994 Eschenbach
5,591,104 A 1/1997 Andrus et al.
5,836,855 A 11/1998 Eschenbach
5,916,065 A 6/1999 McBride et al.
5,989,157 A * 11/1999 Walton ..... 482/4
6,017,295 A 1/2000 Eschenbach
6,080,088 A 6/2000 Petersen et al.

(Continued)

*Primary Examiner*—Steve R Crow
(74) *Attorney, Agent, or Firm*—Chernoff, Vilhauer, McClung & Stenzel

(57) ABSTRACT

An exercise apparatus includes a frame for residing on a horizontal surface, a pair of arm-supporting members for supporting the user's arms and a pair of leg-supporting members for supporting the user's legs. A linkage assembly couples the arm-supporting members and leg-supporting members to the frame and moves the arm-supporting members and leg-supporting members in closed paths relative to the frame in response to user forces applied to the arm-supporting members and leg-supporting members. The linkage assembly includes actuators for adjusting dimensions of the closed paths in response to control signal inputs. Sensors mounted on the linkage assembly generate force-indicating signals representing one or more of the user force. A user interface receives and processes the force-indicating signals and supplies the control signal inputs to the actuators, wherein a dimension of at least one of the closed paths is a function of at least one of the forces applied to the leg and arm-supporting members.

20 Claims, 27 Drawing Sheets

U.S. PATENT DOCUMENTS 6,277,056 B1 8/2001 McBride et al.
6,527,677 B2 3/2003 Maresh
6,672,994 B1 * 1/2004 Stearns et al. ..... 482/57
6,908,416 B2 6/2005 Mercado et al.
7,223,215 B2 * 5/2007 Bastyr ..... 482/115
7,364,532 B2 4/2008 Maresh
7,435,202 B2 * 10/2008 Daly et al. ..... 482/52
7,537,573 B2 * 5/2009 Horst ..... 601/5
7,556,589 B1 * 7/2009 Stearns et al. ..... 482/8

* cited by examiner

ADJUSTABLE STRIDE LENGTH EXERCISE METHOD AND APPARATUS

CROSS-REFERENCE TO RELATED APPLICATIONS

This application is a continuation-in-part of U.S. patent application Ser. No. 11/482,232 filed on Jun. 30, 2006 (U.S. Pat. No. 7,604,574 issued Oct. 20, 2009), which is a continuation of U.S. patent application Ser. No. 09/065,308 filed on Apr. 23, 1998 (U.S. Pat. No. 7,086,993 issued Aug. 10, 2006). This application is also a continuation-in-part of U.S. patent application Ser. No. 10/712,784 filed on Nov. 12, 2003, now U.S. Pat. No. 7,556,589 which is a continuation-in-part of U.S. patent application Ser. No. 09/684,667 filed Oct. 6, 2000 (U.S. patent No. 6,672,994 issued Jan. 6, 2004).

BACKGROUND OF THE INVENTION

1. Field of the Invention

The present invention relates to an exercise apparatus having arm and leg supporting members that travel in closed paths, and more specifically to an exercise apparatus that senses user forces applied to the exercise apparatus and automatically adjusts dimensions of the closed paths in response to the sensed user forces.

2. Description of Related Art

Many exercise apparatuses facilitate both arm movements and leg movements. Examples of such equipment include elliptical exercise apparatuses (U.S. Pat. Nos. 5,242,343, 5,423,729, 5,540,637, 5,725,457, and 5,792,026); free form exercise apparatus (U.S. Pat. Nos. 5,290,211 and 5,401,226); rider exercise apparatus (U.S. Pat. Nos. 2,603,486, 5,695,434, and 5,997,446); glider/strider exercise apparatus (U.S. Pat. Nos. 4,940,233 and 5,795,268); stepper exercise apparatus (U.S. Pat. No. 4,934,690); bicycle exercise apparatus (U.S. Pat. Nos. 4,188,030 and 4,509,742); and various other, miscellaneous exercise apparatus (U.S. Pat. Nos. 4,869,494 and 5,039,088). These patents are incorporated herein by reference as examples of suitable applications for the present invention. Generally speaking, the foregoing exercise apparatuses have arm-supporting members and leg-supporting members synchronized to facilitate a coordinated "total body" exercise motion. Synchronized motion makes the equipment relatively easy to use but the perceived quality of exercise tends to exceed the actual quality of exercise because the arms typically perform very little work. In industry terminology, the arms are generally "along for the ride." Some exercise apparatuses have been developed to provide independent upper body exercise and lower body exercise. One notable example is the NordicTrack ski exercise apparatus (U.S. Pat. No. 4,728,102) but many people consider such exercise apparatuses relatively difficult to use, due to the independent nature of the arm motions and the leg motions. Recognizing that each of the foregoing types of total body exercise apparatus suffers certain shortcomings, room for improvement remains with respect to total body exercise apparatuses.

SUMMARY OF THE INVENTION

The present invention provides unique methods and exercise apparatuses for total body exercise. In one sense, the present invention may be described as encouraging one or more arm-supporting members to be generally synchronized relative to respective leg-supporting member(s) while allowing relative movement between the arm-supporting members and respective leg-supporting members in response to the application of user forces. The present invention may also be said to encourage one or more arm-supporting members to be synchronized relative to respective leg-supporting members while subjecting the arm-supporting members to resistance applied and/or measured independent of the leg-supporting members.

An exercise apparatus in accordance with the invention may include a frame for residing on a horizontal surface, a pair of arm-supporting members for supporting the user's arms and a pair of leg-supporting members for supporting the user's legs. A linkage assembly couples the arm-supporting members and leg-supporting members to the frame and moves the arm-supporting members and leg-supporting members in closed paths relative to the frame in response to user forces applied to the arm-supporting members and/or leg-supporting members.

The linkage assembly includes one or more actuators, each for adjusting a dimension of at least one of the closed paths in response to a control signal input. Each of one or more sensors coupled to the linkage assembly generates a force-indicating signal representing a force the user applies to one of the arm or leg supporting members. A user interface receives the force-indicating signal and supplies a control signal input to each actuator. A dimension of at least one of the closed paths is a function of at least one of the user forces applied to the leg and arm-supporting members.

In the preferred embodiment of the invention, a separate resilient member is interconnected between each arm-supporting member and either the frame or a respective leg-supporting member to bias the arm-supporting member to move through a particular path in response to movement of the respective leg-supporting member. As a result, each arm-supporting member remains synchronized with a respective leg-supporting member in the absence of user force applied against the arm-supporting member.

The preferred embodiment also includes a resistance device providing adjustable resistance to movement of the leg-supporting members and the arm-supporting members, and sensors for detecting user force exerted against respective arm-supporting members. In one desired mode of operation, resistance to movement of the leg-supporting members is set, and the resistance is subsequently adjusted as a function of user force applied against the arm-supporting members. As a result, upper body work can increase or decrease without affecting the amount of lower body work being performed by the user. Alternative embodiments of the present invention may be implemented with this "responsive resistance" arrangement to the exclusion of the resilient members discussed in the preceding paragraph, or with the resilient members to the exclusion of the "responsive resistance" arrangement.

Certain embodiments of the present invention are described in greater detail below and/or shown in the accompanying figures. However, the present invention is not limited to these particular embodiments, or even to the types of exercise apparatuses on which they are shown. Moreover, the present invention is applicable to different combinations of force receiving and/or limb moving members, and additional variations and/or advantages will become more apparent from the detailed description that follows.

BRIEF DESCRIPTION OF THE DRAWINGS

In the following Figures of the Drawing, like numerals represent like parts and assemblies throughout the several views.

DETAILED DESCRIPTION OF PREFERRED EMBODIMENTS

Figure 1:
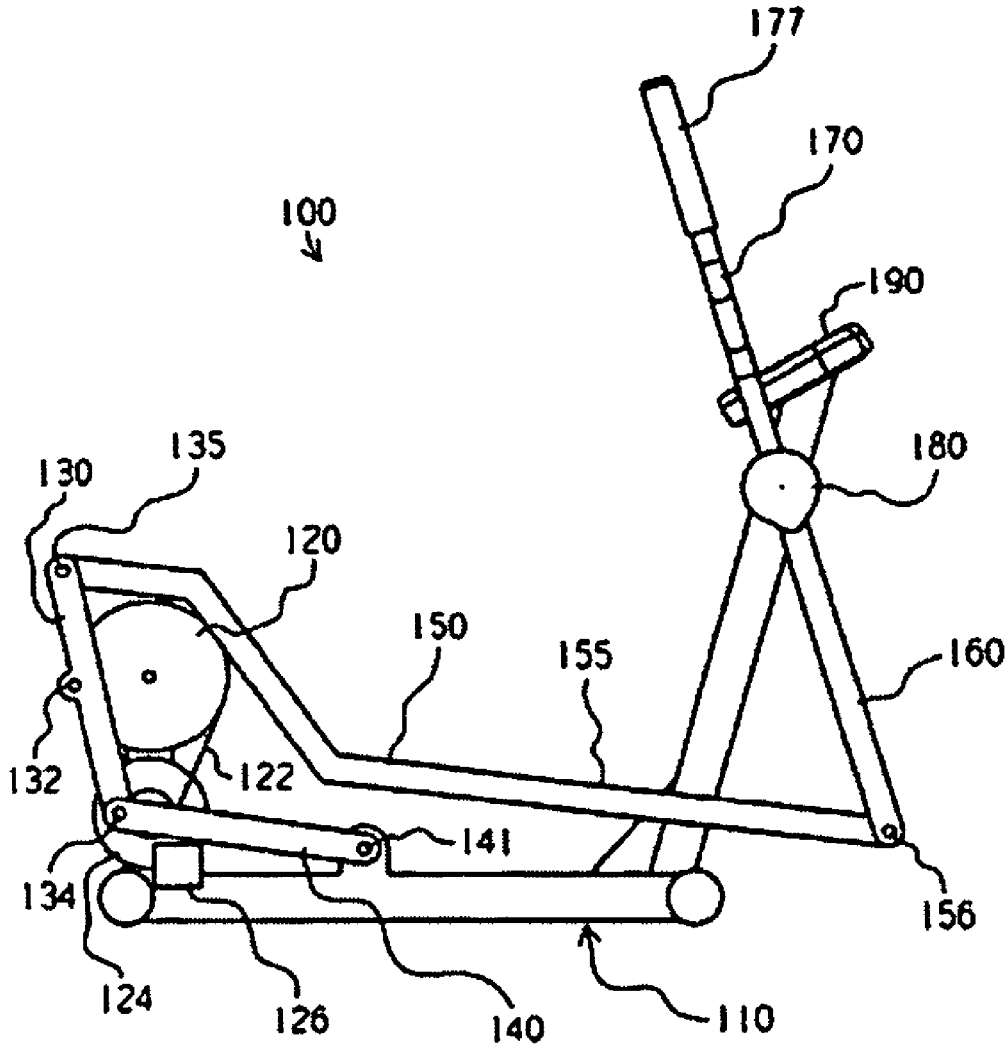
FIG. 1 is a side view of an exercise apparatus constructed according to the principles of the present invention.
Figure 2:
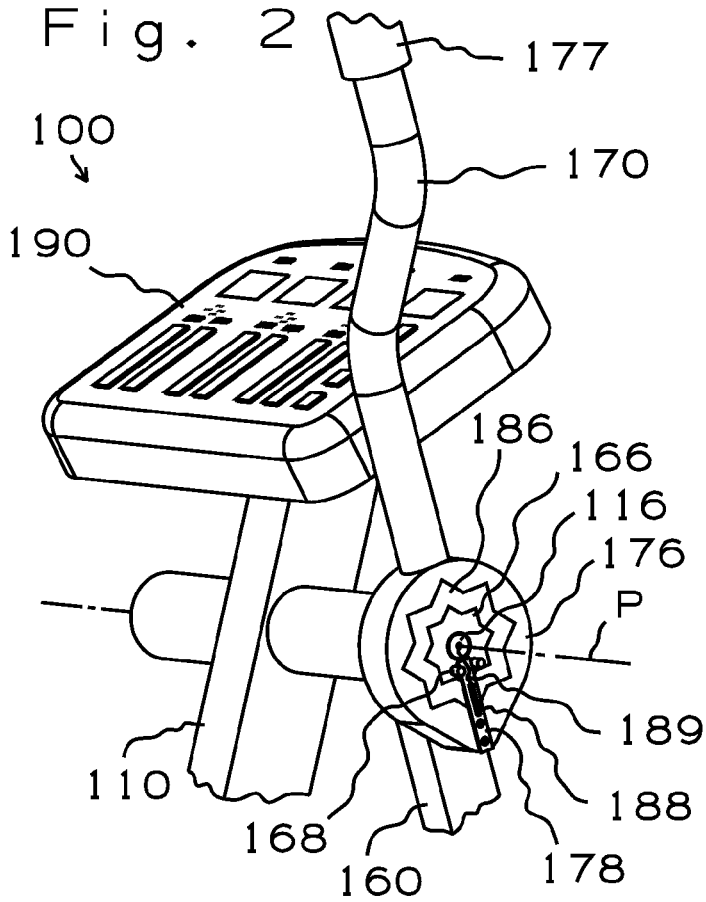
FIG. 2 is an enlarged perspective view of a portion of the exercise apparatus of FIG. 1.

An exercise apparatus constructed according to the principles of the present invention is designated as 100 in FIGS. 1-2. Exercise apparatus 100 is an elliptical motion exercise apparatus that is similar in many respects to exercise apparatus disclosed in U.S. Pat. No. 5,895,339, incorporated herein by reference. However, the present invention is not limited to this specific type of exercise apparatus nor to any particular category of exercise apparatus, but rather, is suitable for use on various sorts of exercise equipment, examples of which are disclosed in the prior art patents identified above.

Exercise apparatus 100 is generally symmetrical about a vertical plane extending lengthwise through its center. Generally speaking, exercise apparatus 100 includes similar "right-hand" components and "left-hand" components disposed on opposite sides of the plane of symmetry that move along similar paths when the exercise apparatus is in use but are one hundred and eighty degrees out of phase relative to one another. Like reference numerals are used to designate both the "right-hand" and "left-hand" parts, and when reference is made to one or more parts on only one side of an exercise apparatus, it is to be understood that corresponding part(s) are disposed on the opposite side of the exercise apparatus. Certain components, which are intersected by the plane of symmetry and/or are associated with the inertial characteristics of the linkage assembly, exist individually and thus, do not have any "opposite side" counterparts.

Exercise apparatus 100 includes a frame 110 configured to rest upon a horizontal floor surface, a pair of arm-supporting members 170 for supporting the user's arms, a pair of leg-supporting, or foot-supporting, members 150 for supporting the user's legs and a linkage assembly for coupling the arm-supporting members and leg-supporting members to frame 110 and for moving the arm-supporting members and leg-supporting members in closed paths relative to the frame in response to forces the user applies to the arm-supporting members and leg-supporting members. The linkage assembly includes left and right cranks 120 rotatably mounted on frame 110 via a common crank shaft . Various other members of the linkage assembly link rotation of cranks 120 to generally elliptical motion of the leg-supporting members 150 and to generally reciprocal motion of arm arm-supporting members 170. The term "generally elliptical motion" is intended in a broad sense to describe a closed path of motion having non-zero dimensions in horizontal and vertical directions. The "stroke length" of foot-supporting member 150 is the dimension of the closed path in the horizontal direction and the "stroke length" of each arm-supporting member 170 is the horizontal dimension of the closed path its upper end 177 follows as the arm-supporting member reciprocates.

Each crank 120 also functions as a pulley (or sprocket), but the invention is not limited to this particular arrangement. A flywheel 124 is rotatably mounted on the rear stanchion, beneath the crank 120, and connected in "stepped-up" fashion to the crank disc 120. In particular, a relatively smaller diameter pulley (or sprocket) is rigidly secured to the flywheel 124 and linked to the crank disc 120 by means of a looped member 122, such as a timing belt (or chain). An eddy current resistance device 126 is mounted on the frame 110 and operatively connected to the flywheel 124. The components described in this paragraph, as well as their arrangement and operation, are well known in the art. Generally speaking, the flywheel 124 adds inertia to the linkage assembly, and the eddy current resistance device 126 provides adjustable resistance to rotation of the flywheel 124 and associated movement of the components of the linkage assembly.

A radially displaced portion of each crank 120 is rotatably connected to an intermediate portion of a respective connector link 130 at a respective connection point 132. The lower end of each connector link 130 is rotatably connected to a rearward end of a respective rocker link 140. An opposite, forward end of each rocker link 140 is pivotally connected to the intermediate trunnion at a respective connection point 141. An opposite, upper end of each connector link 130 is rotatably connected to a rearward end of a respective leg-supporting member 150 at a respective connection point 135. An opposite, forward end of each leg-supporting member 150 is rotatably connected to a lower end of a respective rocker link 160 at a respective connection point 156. An intermediate portion of each leg-supporting member 150 is sized and configured to function as a respective leg support 155. An opposite, upper end of each rocker link 160 is rotatably connected to the forward stanchion at pivot axis P (shown in FIG. 2).

On each side of exercise apparatus 100, a hub 166 is rigidly secured to the upper end of a respective rocker link 160 and has a star-shaped perimeter which projects axially, in a direction away from the central plane of symmetry. A generally annular member 186 has a central, star-shaped opening which fits snugly about a respective hub 166, thereby keying the two members 186 and 166 to one another. For reasons that become more apparent below, the member 186 is resilient and preferably made of rubber. The resilient member 186 has a star-shaped perimeter, which is similar in shape but larger in size than the perimeter of the hub 166. A plate 176 has a central, star-shaped opening which fits snugly about a respective resilient member 186, thereby keying the two members 186 and 176 to one another. An arm-supporting member 170 has a lower end which is rigidly connected to a respective plate 176, and an opposite, upper end 177 which is sized and configured for grasping by a respective hand of a user standing on the leg-supporting members 155.

On each side of exercise apparatus 100, two pegs 168 are rigidly secured to a respective hub 166, project axially outward from the hub 166, and define a gap therebetween. A metal strip 178 has an upper end disposed in the gap between a respective pair of pegs 168, and an opposite, lower end rigidly secured to a respective plate 176. A strain gauge 188 (or other suitable sensor) is mounted lengthwise on a respective strip 178 and connected to a respective wire 189 extending into the frame 110 via a centrally located bore in the pivot shaft. Covers 180, sized and configured to span the exposed side of the plates 176 (and the components within the planform of the plates 176), are preferably secured (bolted, for example) to respective hubs 166 to shroud the components and/or prevent relative axial movement between respective plates 176, annular members 186, and hubs 166.

The strain gauge 188 operates in a manner known in the art to generate an electrical signal indicative of strain experienced by the strip 178 in response to forces the user applies to the arm-supporting member 170 and leg-supporting member 155. An alternative type of suitable sensor may simply measure displacement, for example. Those skilled in the art will also recognize that similar sensor arrangements (and/or flexing arrangements) may be placed on other suitable portions of exercise apparatus 100 to measure work and/or provide tactile feedback in response to the application of user force.

Generally speaking, the arrangement inside each cover 180 biases a respective arm-supporting member 170 to remain in a particular orientation relative to a respective rocker link 160. As a result, each arm-supporting member 170 will simply pivot together with a respective rocker link 160 (entirely "in sync") when a user of exercise apparatus 100 is exercising his lower body to the exclusion of his upper body. However, when the user applies force through either arm-supporting member 170, the respective resilient member 186 will accommodate some pivoting or "flexing" of the arm-supporting member 170 relative to the respective rocker link 160. The freedom to move the arm-supporting member 170 out of sync, although limited in range, tends to provide the user with the sensation of having accomplished something with his upper body independent of the motion associated with exercise of his lower body. In other words, the user can increase the arm exercise stroke relative to the leg exercise stroke, simply by pulling and/or pushing on respective arm-supporting members 170, preferably in a manner which remains coordinated with movement of the rocker links 160. Generally speaking, the length of the arm exercise stroke is a function of force exerted by the user against arm-supporting members 170 under a given set of operating parameters. On the preferred embodiment 100, the dampening effect of the rubber members 186 tends to limit the rate of change in the length of the arm exercise stroke. Also, if desired, the available range of relative motion may be strictly limited by placing overlapping stops on the arm-supporting members 170 and either the rocker links 160 or the frame 110.

Figure 4A:
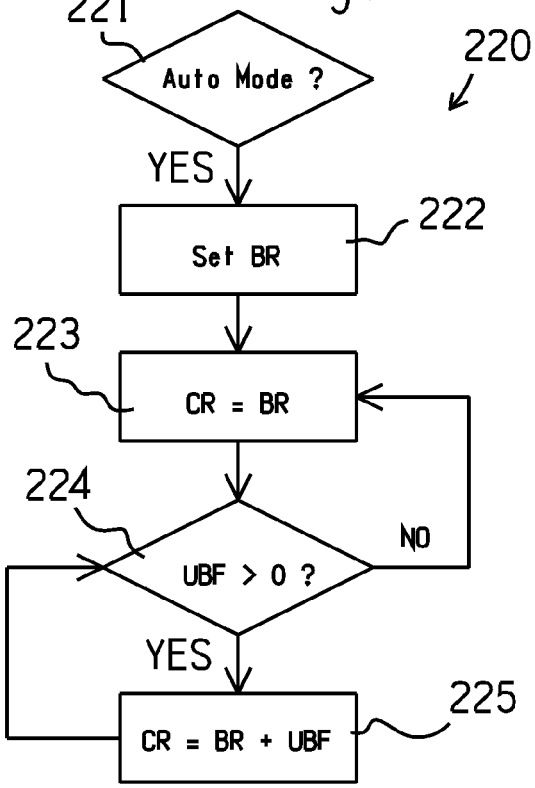
FIG. 4*a* is a flow chart of a control program suitable for use in conjunction with the exercise apparatus of FIG. 1.

Movement of an arm-supporting member 170 relative to a respective rocker link 160 places strain on a respective strip 178. The magnitude of the strain and/or the displacement experienced by the strip 178 may be used to assess the amount of work performed via the user's upper body and/or the relative amounts of work performed via the user's upper body and the user's lower body. This information may be displayed in various forms to the user and/or used in connection with various functions of exercise apparatus 100. For example, FIG. 4*a* shows a flow chart of a program 220 suitable for controlling the resistance device 126 during variable operation of the arm-supporting members 170. The program 220 is described as "Auto Mode" because it is designed to automatically adjust the resistance device 126 as a function of force applied against the arm-supporting members 170.

As an initial step 221, the program 220 activates in response to a signal to enter the Auto Mode. The next step 222 is to set the base resistance (BR) for resisting exercise of the lower body only. For example, the base resistance may be set manually by the user or based upon steady state operation of exercise apparatus 100 over the course of a particular time period. The next step 223 is to set the current resistance (CR) for the resistance device 126 to equal the base resistance (BR). The next step 224 is to process incoming data, if any, from the sensors 188. If no upper body force (UBF) is detected, then the program 220 returns to the step 223 of setting the current resistance (CR) equal to the base resistance (BR). On the other hand, if upper body force (UBF) is detected, then the next step 225 is to increase the current resistance (CR) to provide a reactionary force to the upper body force (UBF). The program 220 then repeats the data processing step 224, which may involve taking multiple samples and/or performing mathematical analysis on the incoming data.

Figure 4B:
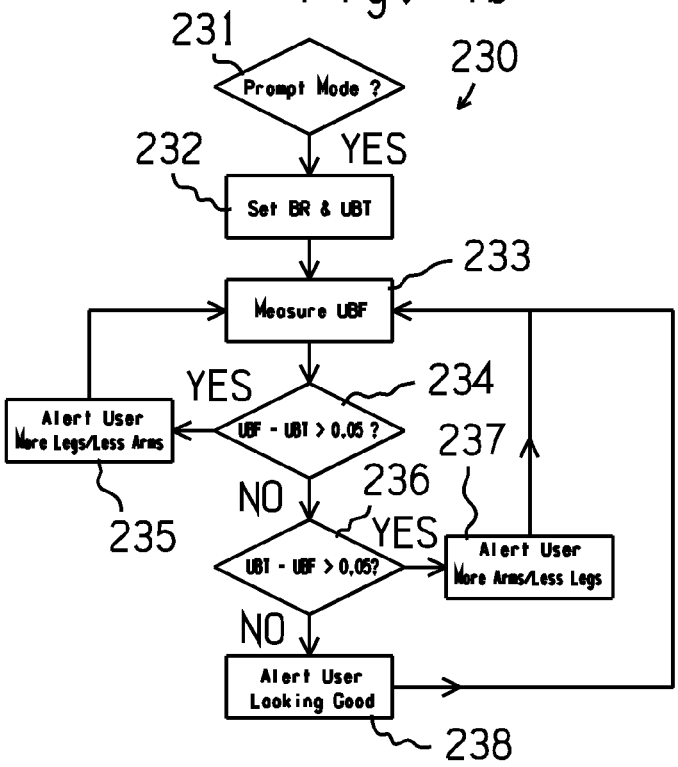
FIG. 4*b* is a flow chart of another control program suitable for use in conjunction with the exercise apparatus of FIG. 1.

FIG. 4*b* shows a flow chart of a program 230 suitable for signaling the user during variable operation of the arm-supporting members 170. The program 230 is described as "Prompt Mode" because it is designed to prompt the user to distribute work between the upper body and lower body in accordance with a predetermined target distribution.

As an initial step 231, the program 230 activates in response to a signal to enter the Prompt Mode. The next step 232 is to set the base resistance (BR) and the upper body target (UBT) as a percentage of the base resistance. For example, the base resistance may be set manually by the user or based upon a heart rate portion of the control program, and the upper body target may be set manually by the user and/or established by another portion of the control program. The next steps 233-238 involve gathering and processing of data from the sensors 188. If step 234 determines that upper body force (UBF) exceeds the upper body target (UBT) by more than 5%, then the next step 235 signals the user to use more legs and/or less arms, and then the sampling step 233 is repeated. Otherwise, step 236 determines whether or not the detected upper body target (UBT) exceeds the upper body force (UBF) by more than 5%. If yes, then step 237 signals the user to use more arm force and/or less leg force, and then the sampling step 233 is repeated. If no, then step 238 signals the user that the actual distribution of work is comparable to the target distribution of work, and then the sampling step 233 is repeated. The program may be further refined to distinguish between the user's left and right arms and/or the user's left and right legs, and/or to compare total actual exertion to a total target level of exertion.

Figure 3:
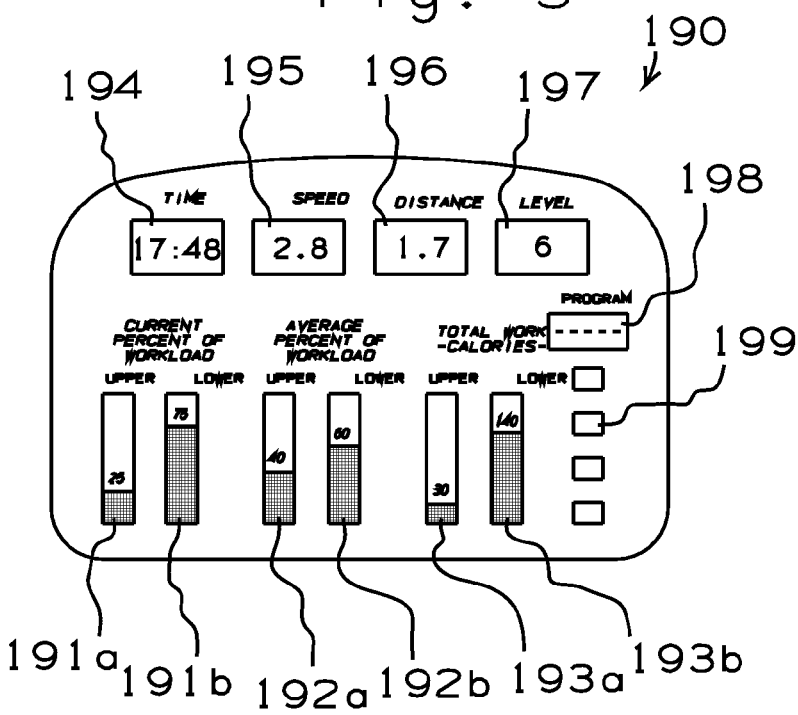
FIG. 3 is a plan view of a user interface on the exercise apparatus of FIG. 1.

As illustrated in FIG. 3, a user interface 190 resides on frame 110. The programs 220 and 230 are stored within a memory chip in the interface 190, and both the strain gauges 188 and the eddy current resistance device 126 are placed in communication with a controller in the user interface 190 (via wires or other suitable means). The user interface 190 may be configured to perform a variety of functions, including displaying information to the user, such as (a) available exercise parameters and/or programs, (b) the current parameters and/or currently selected program (see windows 197 and 198), (c) the current time, (d) the elapsed exercise time (see window 194), (e) the current and/or average speed of exercise (see window 195), (f) the amount of work performed during exercise, (g) the simulated distance traveled during the current workout session and/or over the course of multiple workout sessions (see window 196), (h) material transmitted over the internet, and/or (i) discrete amounts of work being performed by the user's arms and/or legs. With respect to information based upon multiple workout sessions, the interface 190 may be programmed to store such data and also, to distinguish between multiple users of exercise apparatus 100. With regard to the distribution of work, bar graphs 191*a* and 191*b* show the relative amounts of work currently being performed by a user's upper body and lower body, respectively; bar graphs 192*a* and 192*b* show the relative amounts of work performed over the course of a workout by a user's upper body and lower body, respectively; and bar graphs 193*a* and 193*b* show the relative amounts of work performed over the course of multiple workouts by a user's upper body and lower body, respectively.

The user interface 190 may also be configured to perform functions allowing the user to (a) select or change the information being viewed, (b) select or change an exercise program, (c) adjust the resistance to exercise of the arms and/or the legs, (d) adjust the stroke length of the arms and/or the legs (if available), (e) adjust the orientation of the exercise motion (if available), and/or (f) quickly stop the exercise motion of the arms and/or the legs (if available). To facilitate the selection of such options, the user interface 190 includes user operable buttons 199 which may be pushed at various times and/or in various combinations to achieve a desired result.

Those skilled in the art will recognize that various functions of exercise apparatus 100 may be controlled by and/or performed in response to various types of signals, including (a) the user pushing a button 199 on the user interface 190 or on either arm-supporting member 170; (b) a sensor detecting the presence or absence of the user's hands on the arm-supporting members 170; (c) a sensor detecting the user's level of exertion (user exerted force and/or heart rate, for example) for comparison to a target level or range; (d) an automated program; and/or (e) a person other than the user (such as a trainer) who is in communication with the exercise apparatus (via remote control and/or the internet, for example).

Figure 5:
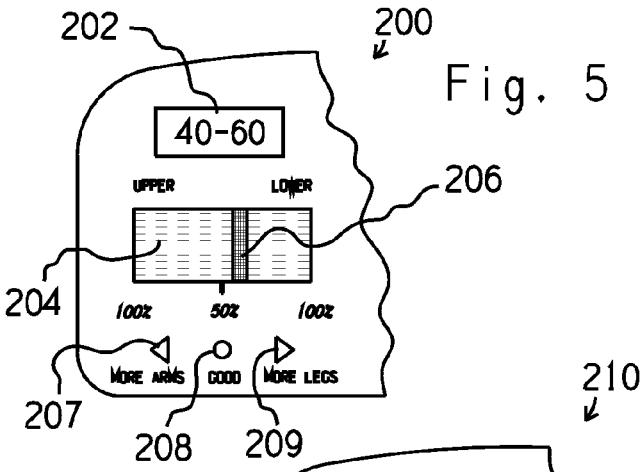
FIG. 5 is a plan view of an alternative user interface display.

Those skilled in the art will also recognize that other types of input devices and/or displays may be used without departing from the scope of the present invention. For example, FIG. 5 shows an alternative user interface 200 with two alternative displays of the relative amounts of work performed by a user's upper body and lower body. A first, digital display 202 shows the percentage of work performed by the user's upper body adjacent to the percentage of work performed by the user's lower body. A second, analog display includes a scale 204 and an indicator 206, which moves along the scale 204 to indicate the percentage of work being performed by the portion of the user's body that is currently performing the majority of the work. The user interface 200 also includes three LED displays 207-209 which may be alternatively lit to indicate the relationship between the user's current distribution of work and the user's target distribution of work. More specifically, the illumination of display 207 signals the user to increase the emphasis on upper body exercise; the illumination of display 208 signals the user to maintain the current distribution of work between upper body and lower body; and the illumination of display 209 signals the user to increase the emphasis on lower body exercise. Those skilled in the art will recognize that audible signals may be used together with or in place of visible signals.

Figure 6:
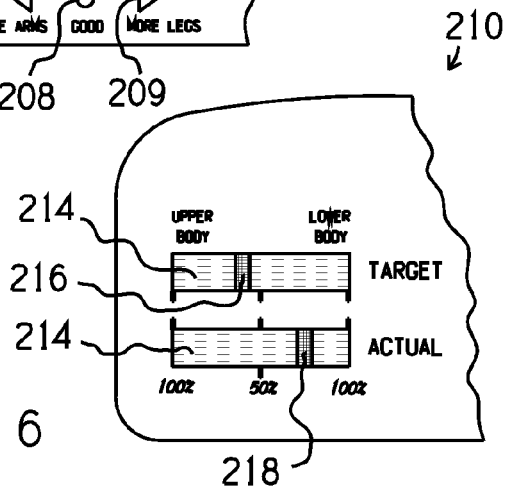
FIG. 6 is a plan view of another alternative user interface display.

Another alternative user interface 210 is shown in FIG. 6. Two analog displays are aligned relative to one another to facilitate a visual comparison between the target distribution of work and the actual distribution of work. Each display includes an identical scale 214 and a respective indicator 216 or 218. The indicator 216 moves along the upper scale 214 to indicate the user's target distribution of work between upper body and lower body, and the indicator 218 moves along the lower scale 214 to indicate the user's actual distribution of work between upper body and lower body. All of the foregoing displays may be enhanced to distinguish between the left and right sides of the person's body, as well.

Figure 7:
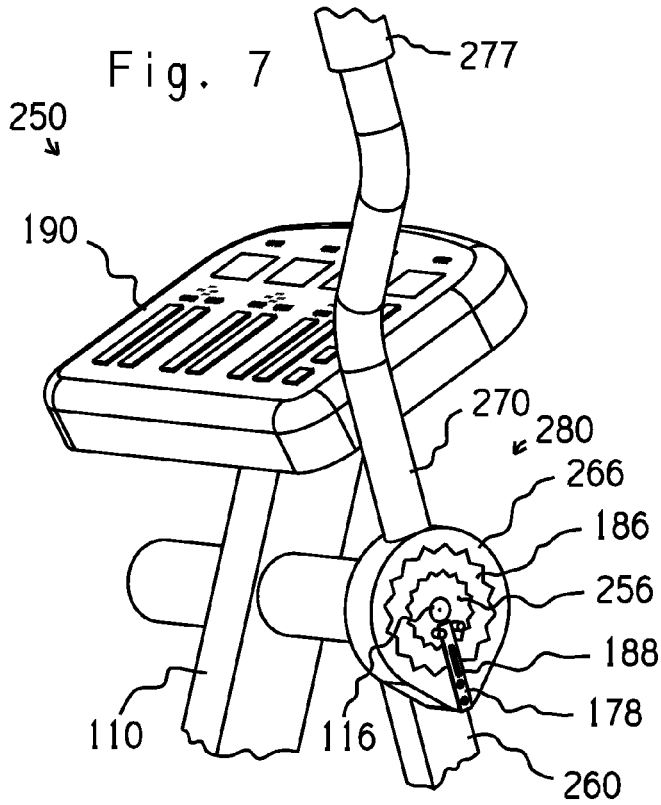
FIG. 7 is a perspective view of another exercise apparatus constructed according to the principles of the present invention.

Another exercise apparatus that can be adapted to employ the present invention is shown in FIG. 7. As suggested by the common reference numerals, exercise apparatus 250 is similar to the first embodiment 100 of FIG. 2, except for the rocker link 260, the arm-supporting member 270, and the manner in which they are connected to one another and the frame 110 at connection assembly 280. In particular, a steel hub 256 is rotatably mounted on shaft 116, and a resilient member 186 is mounted on and about the hub 256, and a steel plate 266 is mounted on and about the resilient member 186. In other words, the resilient member 186 is interconnected between the hub 256 and the plate 266. Both the rocker link 260 and the arm-supporting member 270 are rigidly secured to the plate 266. In response to the application of user force against the upper end 277 of the arm-supporting member 270, the resilient member 186 accommodates movement of the arm-supporting member 270 from its otherwise synchronized path of motion, and the strip 178 experiences strain as a function of such force.

Another, related embodiment may be implemented by switching each connection assembly 280 with a respective pivot joint 156 defined between the rocker link 260 and the leg-supporting member 150. Yet another approach is to form the arm-supporting members and respective rocker links as unitary pieces and place suitable sensors on the upper ends 277 of the arm-supporting members or between the arm-supporting members and movable handgrips on the arm-supporting members.

Figure 8:
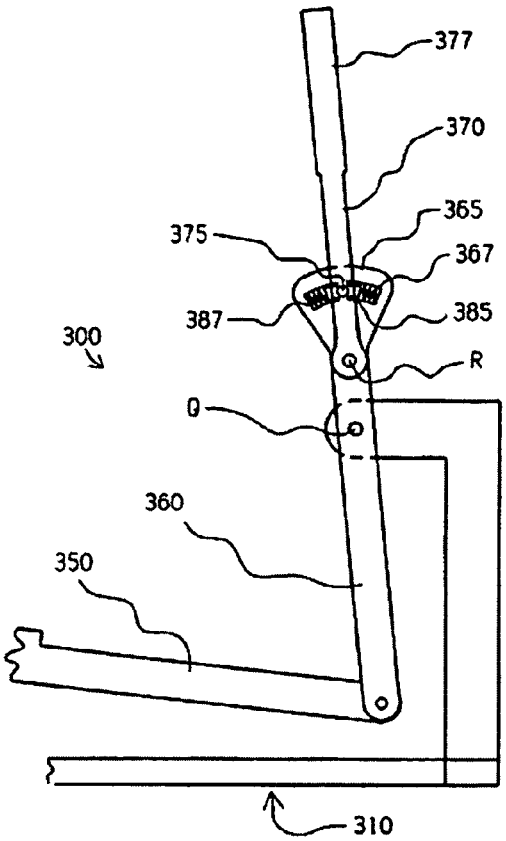
FIGS. 8-11 are side views of other exercise apparatuses.

Still another exercise apparatus that can be adapted to employ the present invention is designated as 300 in FIG. 8. Exercise apparatus 300 includes a frame 310 residing upon a floor surface, and a leg exercise assembly similar to that on the first embodiment 100. Among other things, the leg exercise assembly includes left and right leg-supporting members 350 having forward ends rotatably connected to lower ends of respective rocker links 360. An intermediate portion of each rocker link 360 is rotatably connected to the frame 310 at pivot axis Q. Left and right arm-supporting members 370 have respective lower ends rotatably connected to respective rocker links 360 at respective pivot axes R (disposed a distance above the pivot axis Q). An opposite, upper end 377 of each arm-supporting member 370 is sized and configured for grasping by a person standing on the leg-supporting links 350.

An upper end 365 of each rocker link 360 is configured to provide an arcuate slot 367 which is centered about a respective pivot axis R. A respective block 385 is movably mounted within each slot 367, and is rigidly secured to an intermediate portion of a respective arm-supporting member 370 (by means of a bolt 375, for example). First and second resilient members 387 are preferably disposed in respective gaps defined between opposite sides of the block 385 and opposite ends of the slot 367 to bias the arm-supporting member 370 toward an aligned orientation relative to the rocker link 360. On this embodiment 300, the resilient members 387 are helical coil springs.

In the absence of user force applied against the arm-supporting members 370, the arm-supporting members 370 pivot in synchronized fashion together with respective rocker links 360. However, the resilient members 387 allow the arm-supporting members 370 to be forcibly moved relative to respective rocker links 360 at the discretion (and strength) of the user. The embodiment 300 is shown without strain gauges or other sensors to emphasize that the "flexible synchronization" aspect of the present invention and the "responsive resistance" aspect of the present invention and the "display of work distribution" aspect of the present invention may used independent of each other. Additional examples include replacing the resilient member 186 on the embodiment 250 with a similarly sized and shaped rigid member, and/or replacing the strip 178 on the embodiment 100 with a sufficiently strong bar rigidly secured to both the plate 176 and the hub 166.

On an exercise apparatus 300 comprising a frame 310 designed to rest upon a floor surface; an arm-supporting member 370; and a leg-supporting member 350, wherein at least one of the supporting members is movably mounted on the frame, the present invention may be described in terms of (a) linkage assembly for interconnecting the leg-supporting member 350 and the arm-supporting member 370 in such a manner that the path traversed by the user's hand is synchronized relative to the path traversed by the user's foot, until a threshold amount of user force is applied against the arm-supporting member, in which case, the hand path may deviate from its otherwise synchronized path relative to the foot path; and/or (b) a linkage assembly for connecting the leg-supporting member and the arm-supporting member in such a manner that the path traversed by the user's hand is synchronized relative to the path traversed by the user's foot and movable against a resistance force which is measured and/or applied independent of the leg-supporting member; and/or (c) a user interface for displaying the distribution of work between a user's upper body and lower body.

The present invention also may be said to provide various methods, which may be implemented in connection with various exercise apparatuses including the foregoing examples. One such method is to provide arm-supporting members and leg-supporting members, which are both synchronized and subject to independent resistance. Another such method is to provide arm-supporting members and leg-supporting members, which are both encouraged to remain synchronized and selectively movable relative to one another. Yet another method is to move a person's hands and feet through respective paths which are synchronized relative to one another, while allowing deviation from the synchronized path in response to user applied force and/or providing separate resistance to movement along the respective paths. Yet another method is to measure and/or display work performed separately by a person's upper body and lower body.

Figure 9:
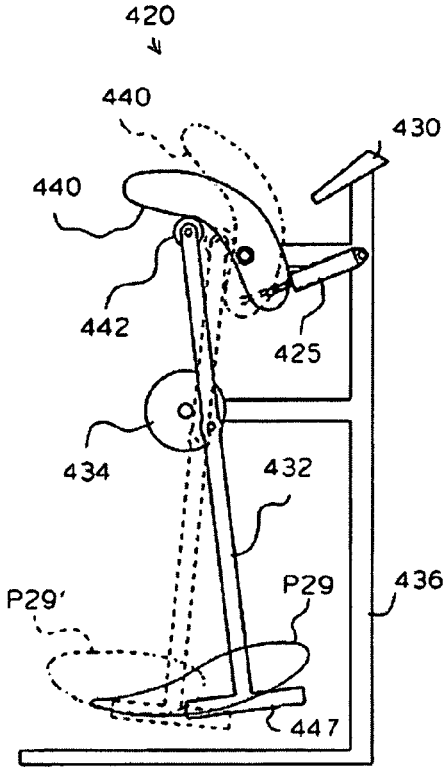

FIG. 9 shows an exercise apparatus 420 using a cam and roller arrangement in lieu of a rocker link to constrain a portion of each connector link to move in reciprocal fashion relative to a frame to the extent that it essentially switches the relative locations of the crank joint and the roller on each connector link.

Exercise apparatus 420 may be generally described in terms a frame 436 designed to occupy a fixed position relative to a floor surface; left and right cranks 434 rotatably mounted on the frame 436; at least one bearing surface 440 mounted on the frame 436; and left and right connector links 432 having lower distal ends which are connected to respective leg-supporting members 447, intermediate portions which are rotatably connected to radially offset portions of respective cranks 434, and upper distal ends which are rotatably connected to respective rollers 442 that bear against the bearing surface 440. The resulting linkage assembly links rotation of the cranks 434 to generally elliptical movement of the leg-supporting members 447. The "stroke length" of each foot-supporting member 447 is its dimension in a generally horizontal direction.

The bearing surface 440 has a first support portion, which is rotatably connected to the frame 436, and a second support portion, which is rotatably connected to an end of an actuator 425. An opposite end of the actuator 450 is rotatably connected to the frame 436. A display 430 provides information to a user of exercise apparatus 420 and sends control signals to the actuator 425 to adjust its dimensions. When the bearing surface 440 occupies the position shown in solid lines in FIG. 9, the leg-supporting members 447 move through the path designated as P29. When the bearing surface 440 occupies the position shown in dashed lines, the leg-supporting members 447 move through the path designated as P29'. The bearing surface 440 could be replaced by a more complicated structural member disposed about the roller and configured to constrain same to travel in either true reciprocating fashion or along a closed curve path.

Figure 10:
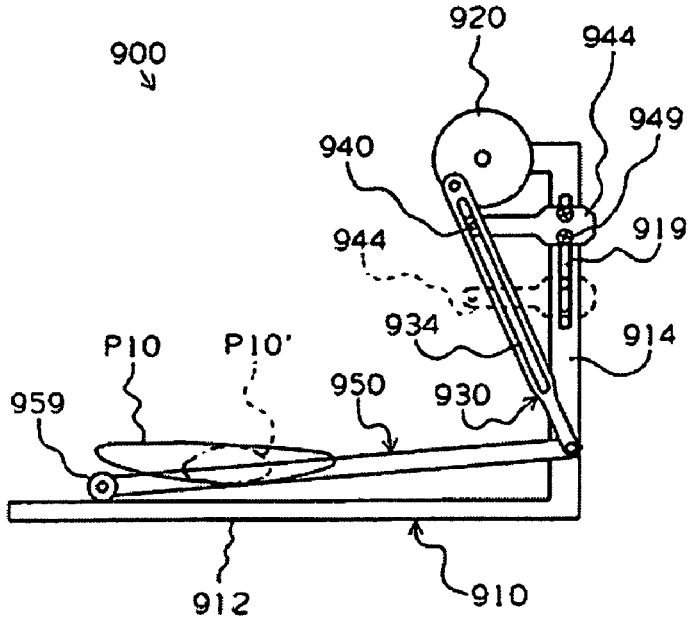

FIG. 10 shows an exercise apparatus 900 having a frame 910 including a base 912 designed to rest upon a floor surface, and a stanchion 914 extending upward from an end of the base 912. Left and right cranks 920 are rotatably mounted on opposite sides of the stanchion 914 and rotate about a common crank axis relative thereto. The cranks 920 may be flywheels or crank arms, which are optionally connected to a flywheel, either directly or in "stepped-up" fashion.

On each side of exercise apparatus 900, a first end of a connector link 930 is rotatably connected to a respective crank 920 (by means of a pin joint). A slot 934 is provided along an intermediate portion of each connector link 934 to receive a bearing member 940. The bearing members 940 are mounted on a common bracket 944, which is rigidly secured in any of several locations along the stanchion 914. More specifically, at least one fastener 949 extends through the bracket 944 and into a slot 919 in the forward stanchion 914. The fasteners 949 selectively lock and unlock the bracket 944 in place relative to the stanchion 914 to facilitate adjustment of the former relative to the latter.

Left and right leg-supporting members 950 have first ends, which are rotatably connected to second, opposite ends of respective connector links 930 (by means of pin joints). Left and right rollers 959 are rotatably connected to second, opposite ends of respective leg-supporting links 950, and the rollers 959 travel along at least one underlying surface on the base 912 (or the floor). An intermediate portion of each leg-supporting member 950 is sized and configured to support a respective foot of a standing person.

The arrangement of linkage assembly components is such that rotation of the cranks 920 is linked to generally elliptical movement of the intermediate portions of the leg-supporting members. When the bracket 944 occupies the position shown in solid lines in FIG. 10, a person's foot moves through the path designated as P10. When the bracket 944 occupies the position shown in dashed lines in FIG. 10, a person's foot moves through the path designated as P10'. Among other things, a powered actuator such as, for example actuator 425 of FIG. 9, could be substituted for the fasteners 949 to facilitate adjustments to the path configuration during exercise and/or in response to a control signal.

Figure 11:
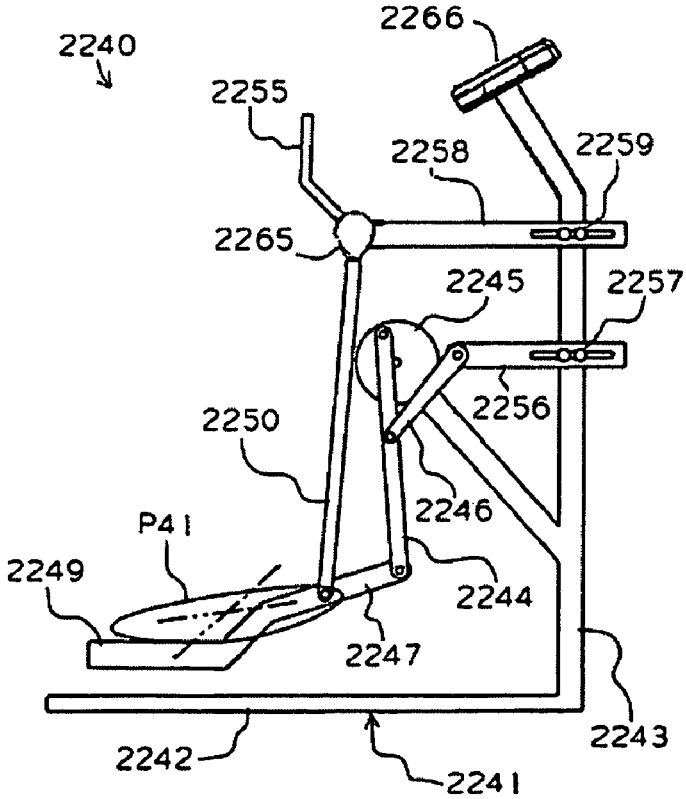

FIG. 11 depicts yet another exercise apparatus 2240 that can be adapted to employ the present invention, the exercise apparatus including a frame 2241 having a base 2242 designed to occupy a fixed position relative to a floor surface, and a stanchion 2243 extending upward from an end of the base 2242. Left and right connector links 2244 have (a) first ends rotatably connected to respective cranks 2245, which in turn, are rotatably mounted on opposite sides of the stanchion 2243; (b) intermediate portions rotatably connected to respective rocker links 2246, which in turn, are rotatably connected to opposite sides of the stanchion 2243; and (c) second, opposite ends rotatably connected to forward ends of respective leg-supporting members 2247. Arm-supporting members 2255 are sized and configured for grasping by the user. An opposite, rearward end 2249 of each leg-supporting member 2247 is sized and configured to support a respective foot of a standing person. An intermediate portion of each leg-supporting member 2247 is rotatably connected to a lower end of a respective rocker link 2250. The rocker link 2250 and arm-supporting member 2255 are rotatably coupled to stanchion 2243 and to one another through a hub assembly 2265 similar to the hub assembly (116, 166, 168, 178, 180 186, 188, 189) of FIGS. 1 and 2 containing a strain gauge for monitoring user forces applied to arm-supporting member 2255.

The leg-supporting members 2247 extend substantially parallel to an underlying floor surface, and the connector links 2244 and rocker links 2250 extend substantially perpendicular to the underlying floor surface. The resulting linkage assembly links rotation of the cranks 2245 to generally elliptical movement of the leg-supporting members 2249 through the path designated as P41. The pivot axes of the rocker links 2246 and/or the rocker links 2250 may be adjusted relative to the frame 2241 to change the path of exercise motion. On exercise apparatus 2240, for example, each rocker link is rotatably connected to a respective bracket 2256 or 2258, which in turn, is movable horizontally relative to the stanchion 2243. Slots in the brackets 2256 and 2258 provide the necessary degree of freedom, and fasteners 2257 and 2259 releasably lock the respective brackets 2256 and 2258 in place.

A user interface 2266, similar to user interface 190 of FIG. 2, mounted on stanchion 2243, receives the force-indicating signal produced by the strain gauge in hub 2265. Among other things, powered actuators, for example similar to actuator 425 of FIG. 9, could be substituted for the fasteners 2257 and 2259 to facilitate adjustments to the path configuration during exercise and/or in response to control signals from controller 2266. User interface 2266 may also be configured to perform functions allowing the user to (a) select or change the information being viewed, (b) select or change an exercise program, (c) adjust the resistance to exercise of the arms and/or the legs, (d) adjust the stroke length of the arms and/or the legs, (e) adjust the orientation of the exercise motion (if available), and/or (f) quickly stop the exercise motion of the arms and/or the legs (if available).

Those skilled in the art will recognize that various functions of exercise apparatus 2240 may be controlled by and/or performed in response to various types of signals, including (a) the user pushing a button on the user interface 2266 or on either arm-supporting member 2255; (b) a sensor detecting the presence or absence of the user's hands on arm-supporting members 2255; (c) a sensor detecting the user's level of exertion (user exerted force and/or heart rate, for example) for comparison to a target level or range; (d) an automated program; and/or (e) a person other than the user (such as a trainer) who is in communication with the exercise apparatus (via remote control and/or the internet, for example).

Figure 12:
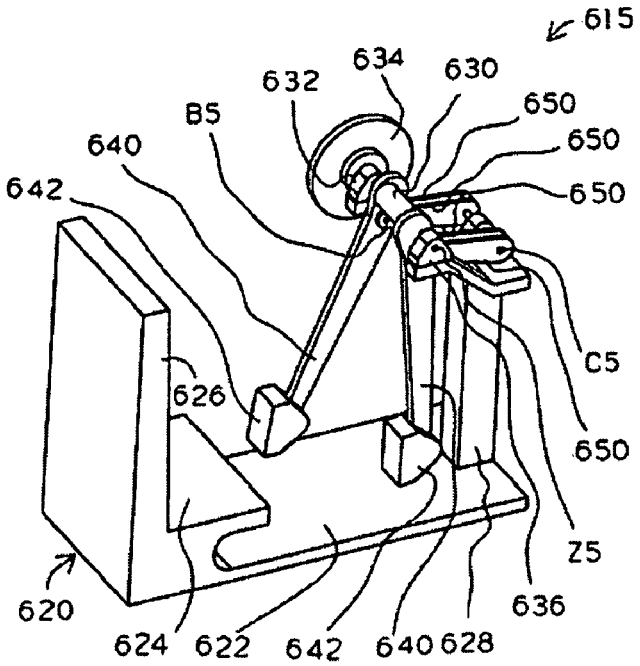
FIG. 12 is a perspective view of an exercise apparatus.

Another exercise apparatus that can be adapted to employ the present invention is designated as 615 in FIG. 12. Exercise apparatus 615 has a frame 620 which includes a base 622 designed to rest upon a floor surface. A seat 624 and a back support 626 are secured to a rearward end of the base 622 to support a user. A stanchion 628 is secured to an opposite, forward end of the base 622 to support a linkage assembly. A user sits in the seat 624 and places individual feet on respective foot receiving elements 642. The user exercises by pushing against the foot receiving elements 642 in alternating fashion. The foot receiving members 642 move through generally elliptical paths of motion as a flywheel 634 rotates.

The linkage assembly includes a camshaft 630 which is rotatably mounted on the stanchion 628 by means of bearing assemblies 636. The flywheel 634 shares an axis of rotation Z5 with the camshaft 630 and rotates together therewith relative to the frame 620. On each side of exercise apparatus 615, a first link 640 has an upper end which is rotatably mounted on an eccentric portion of the camshaft 630. The link 640 rotates about an axis relative to the eccentric portion, which in turn, rotates about the camshaft axis Z5. The eccentric portion on the right side of exercise apparatus 615 is diametrically opposite the eccentric portion on the left side of exercise apparatus 615. A foot receiving element 642 is pivotally mounted on an opposite, lower end of each first link 640. Each foot receiving element 642 is movable through a limited range of motion relative to a respective first link 640.

On each side of exercise apparatus 615, two second links 650 have first ends rotatably connected to a respective first link 640, beneath the camshaft 630 and proximate same, and second, opposite ends rotatably connected to the stanchion 628. As a result, the second links 650 rotate about respective axes B5 relative to respective first links 640 and about a common axis C5 relative to the frame 620. Thus, the second links 650 may be described as "rocker links" and/or as means for constraining respective axes B5 to move in reciprocating fashion.

Figure 13:
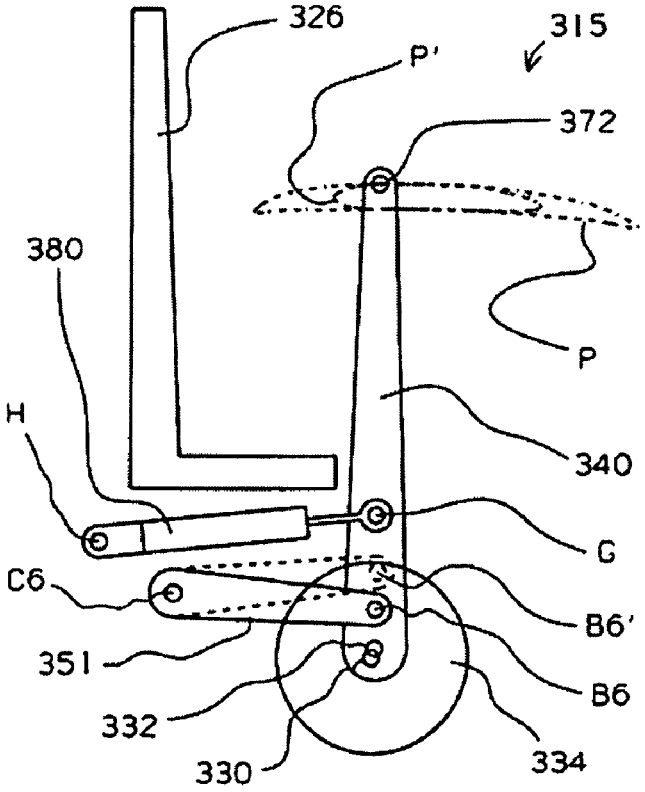
FIG. 13 is a side view of the exercise apparatus of FIG. 12, with the linkage members depicted at four different times during an exercise cycle.

Another exercise apparatus that can be adapted to employ the present invention is designated as 315 in FIG. 13. Exercise apparatus 315 has a frame (not shown) and a seat 324 and a back support 326 which are secured to the frame. A linkage assembly is connected to the frame generally beneath the seat 324. A user sits in the seat 324 and places his hands on opposite sides of a hand receiving element 372. The user exercises by moving the hand receiving member 372 through generally elliptical paths of motion as a flywheel 334 rotates.

The linkage assembly includes a camshaft 330 having an eccentric portion 332. The flywheel 334 shares an axis of rotation with the camshaft 330 and rotates together therewith relative to the frame. A first link 340 has a lower end which is rotatably mounted on the eccentric portion 332 of the camshaft 330. The link 340 rotates about an axis relative to the eccentric portion 332, which in turn, rotates about the camshaft axis. The hand receiving element 372 is mounted on an opposite, upper end of the first link 340.

A second link 351 has a first end rotatably connected to the first link 340 above the camshaft 330 and proximate same. As a result, the second link 351 rotates about an axis B6 relative to the first link 340. The second link 351 has a second, opposite end rotatably connected to the frame and thus, also rotates about an axis C6 relative to the frame. The second link 351 may be described as a "rocker link" and/or as a means for constraining the axis B6 to move in reciprocating fashion.

Exercise apparatus 315 provides an optional means for adjusting the length of the exercise stroke or path of motion. In particular, the rocker link 351 may be connected to a different point along the first link 340, as suggested by the dashed line depiction thereof in FIG. 13. The hand receiving member 372 moves through a path P when the rocker link 351 defines the axis B6, and the hand receiving member 372 moves through a smaller path P' when the rocker link 351 defines the axis B6'.

An optional resistance device 380 (which could be a linear damper or a fluid shock absorber, for example) is shown on exercise apparatus 315. A first end of the resistance device 380 is rotatably connected to the first link 340 and cooperates therewith to define an axis of rotation G. A second, opposite end of the resistance device 380 is rotatably connected to the frame and cooperates therewith to define an axis of rotation H. The resistance device may be configured to provide adjustable resistance and/or resistance in only one direction. Moreover, other resistance devices could be added to or substituted for the damper arrangement. For example, a spring may be disposed between the first link 340 and the frame to resist movement of the first link 340 away from the back support 326.

Those skilled in the art will recognize that the resistance device 380 and/or the adjustable rocker link 351 may be used on other embodiments of the present invention, as well, and conversely, that features of the other embodiments could be included on exercise apparatus 315. For example, exercise apparatus 315 could be modified to have reciprocating right and left hand receiving members (and/or foot receiving members) similar in operation to the foot receiving members of the embodiment 615.

Figure 14:
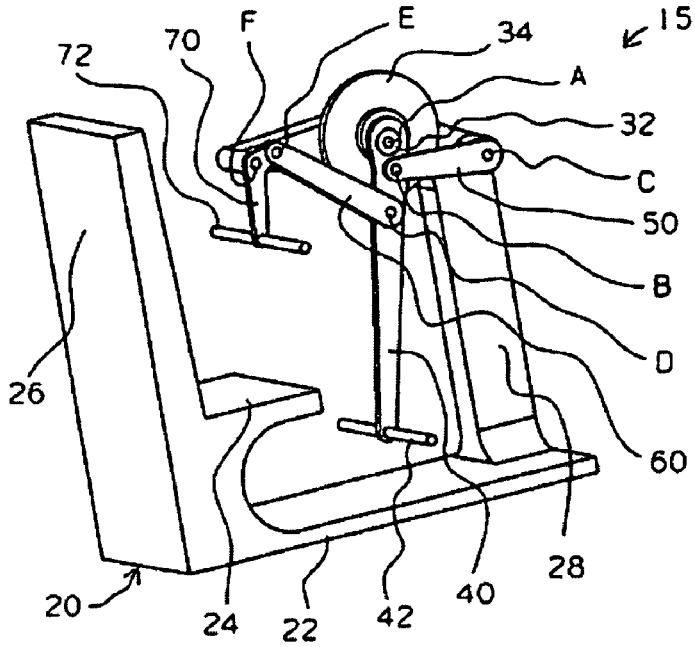
FIGS. 14 and 15 are perspective views of other exercise apparatuses.
Figure 15:
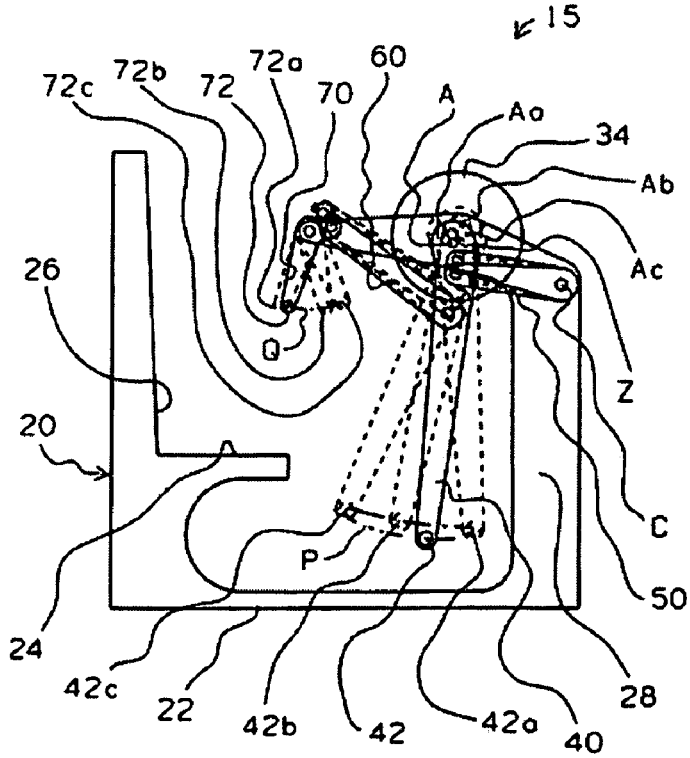
Figure 16:
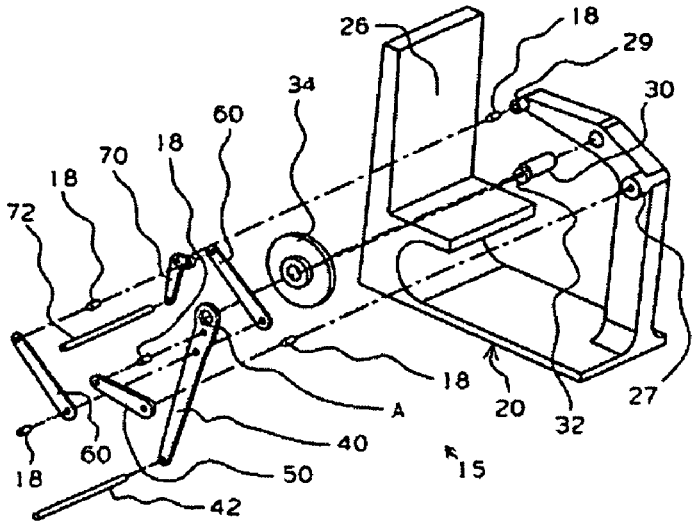
FIG. 16 is an exploded perspective view of the exercise apparatus of FIG. 15.

An exercise apparatus constructed according to the principles of the present invention is designated as 15 in FIGS. 14-16. Exercise apparatus 15 has a frame 20 which includes a base 22 designed to rest upon a floor surface. A seat 24 and a back support 26 are secured to a rearward end of the base 22 to support a user. A stanchion 28 is secured to an opposite, forward end of the base 22 to support a linkage assembly. A user sits in the seat 24 and places both feet on a foot receiving element 42 and both hands on a hand receiving element 72. The user exercises by alternatively pushing against the foot receiving element 42 and the hand receiving element 72.

The linkage assembly includes a camshaft 30 which is rotatably mounted on the stanchion 28. A flywheel 34 is mounted on the camshaft 30 and rotates together therewith about an axis Z relative to the frame 20. A first link 40 has an upper end which is rotatably mounted on an eccentric portion 32 of the camshaft 30. The link 40 rotates about an axis A relative to the eccentric portion 32, and the axis A, in turn, rotates about the axis Z. The foot receiving element 42 is mounted on an opposite, lower end of the first link 40.

A second link 50 has a first end rotatably connected to the first link 40 by means of a pin 18. As a result, the second link 50 rotates about an axis B relative to the first link 40. The axis B may be described as proximate the upper end of the first link 40. The second link 50 has a second, opposite end rotatably connected to the frame 20 at axially extending shoulder portion 27. As a result, the second link 50 also rotates about an axis C relative to the frame 20. The second link 50 may be described as a "rocker link" and/or as a means for constraining the axis B to move in reciprocating fashion.

Third links 60 have first ends rotatably connected to opposite sides of the first link 40 by means of a pin 18. As a result, the third links 60 rotate about an axis D relative to the first link 40. The axis D may be described as proximate the upper end of the first link 40, and/or the axis B may be described as intermediate the axis D and the axis A. The third links 60 have second, opposite ends rotatably connected to an end of a fourth link 70. As a result, the third links 60 also rotate about an axis E relative to the fourth link 70.

The fourth link 70 has an intermediate portion rotatably connected to the frame 20 at axially extending shoulder portion 29. As a result, the fourth link 70 rotates about an axis F relative to the frame 20. The hand receiving member 72 is mounted on an end of the fourth link 70 opposite the axis E. The fourth link 70 may be described as generally L-shaped with the axis F disposed at the vertex (and between the axis E and the hand receiving member 72).

As shown in FIG. 15, rotation of the flywheel 34 is linked to movement of the foot receiving member 42 through a generally elliptical path of motion P, and movement of the hand receiving member 72 through an arcuate path of motion Q. For example: (i) when the eccentric axis A is at seven o'clock relative to the camshaft axis Z, the foot receiving member 42 and the hand receiving member 72 occupy the positions shown in solid lines; (ii) when the eccentric axis is at the ten o'clock orientation (designated as Aa), the foot receiving member and the hand receiving member occupy the positions designated as 42*a* and 72*a* (and the user is likely to begin pushing against the hand receiving element); (iii) when the eccentric axis is at the one o'clock orientation (designated as Ab), the foot receiving member and the hand receiving member occupy the positions designated as 42*b* and 72*b*; and (iv) when the eccentric axis is at the four o'clock orientation (designated as Ac), the foot receiving member and the hand receiving member occupy the positions designated as 42*c* and 72*c* (and the user is likely to begin pushing against the foot receiving element). On the embodiment 15, the rocker link 50 oscillates through a range of approximately seven and one-half degrees during a complete exercise cycle, and the crank radius defined between the axis Z and the axis A is approximately one-half of an inch.

The flywheel 34 adds inertia to the linkage assembly, so that the user need not continuously push against the appropriate force receiving member. On the other hand, the user may continuously exercise his upper body by pushing and pulling against the hand receiving member 72 at the appropriate times. Also, toe loops or straps may be provided on the foot receiving member 42 to allow the user to push and pull against same and thereby continuously exercise his lower body.

Figure 17:
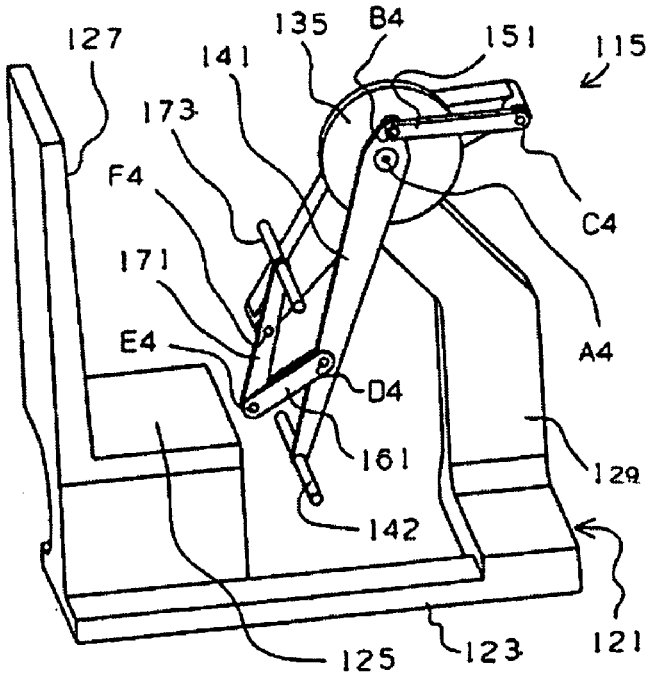
FIG. 17 is a side view of another exercise apparatus.

Another exercise apparatus that can be adapted to employ the present invention is designated as 115 in FIG. 17. Exercise apparatus 115 has a frame 121 which includes a base 123 designed to rest upon a floor surface. A seat 124 and a back support 127 are secured to a rearward end of the base 123 to support a user. A stanchion 129 is secured to an opposite, forward end of the base 123 to support a linkage assembly. A user sits in the seat 125 and places both feet on a foot receiving element 142 and both hands on a hand receiving element 172. The user may exercise by alternatively pushing against the foot receiving element 142 and the hand receiving element 172.

The linkage assembly includes a camshaft (like that on exercise apparatus 15) which is rotatably mounted on the stanchion 125. A flywheel 134 is mounted on the camshaft and rotates together therewith about a camshaft axis relative to the frame 121. A first link 141 has an upper portion which is rotatably mounted on an eccentric portion of the camshaft. The link 141 rotates about an axis A4, which in turn, rotates about the camshaft axis. The foot receiving element 142 is mounted on a lower distal end of the first link 141.

A second link 151 has a first end rotatably connected to an upper distal end of the first link 141. As a result, the second link 151 rotates about an axis B4 relative to the first link 141. The axis B4 may be described as disposed above the axis A4. The second link 151 has a second, opposite end rotatably connected to the frame 121 at axially extending shoulder portion on the stanchion 129. As a result, the second link 151 also rotates about an axis C4 relative to the frame 121. The second link 151 may be described as a "rocker link" and/or as a means for constraining the axis B4 to move in reciprocating fashion.

Third links 161 have first ends rotatably connected to opposite sides of the first link 141. As a result, the third links 161 rotate about an axis D4 relative to the first link 14'. The axis D4 may be described as proximate the lower end of the first link 141 and/or intermediate the axis A4 and the foot receiving member 142. The third links 161 have second, opposite ends rotatably connected to an end of a linear fourth link 171. As a result, the third links 161 also rotate about an axis E4 relative to the fourth link 171.

The fourth link 171 has an intermediate portion rotatably connected to the frame 121 at axially extending shoulder portion on the stanchion 129. As a result, the fourth link 171 rotates about an axis F4 relative to the frame 121. The hand receiving member 172 is mounted on an end of the fourth link 171 opposite the axis E4.

Like on exercise apparatus 15, rotation of the flywheel 135 is linked to movement of the foot receiving member 142 through a generally elliptical path of motion, and movement of the hand receiving member 172 through an arcuate path of motion. The rocker link 151 is disposed above the camshaft axis in the second embodiment 115, and the motions are comparable (though generally inverse) to those on the first embodiment 15 (where the rocker link 50 is disposed beneath the camshaft axis Z). The exercise path provided by either embodiment may be varied by rotating the rocker axis (C or C4) about the camshaft axis (so that the rocker link 50 or 151 is no longer horizontal).

Figure 18:
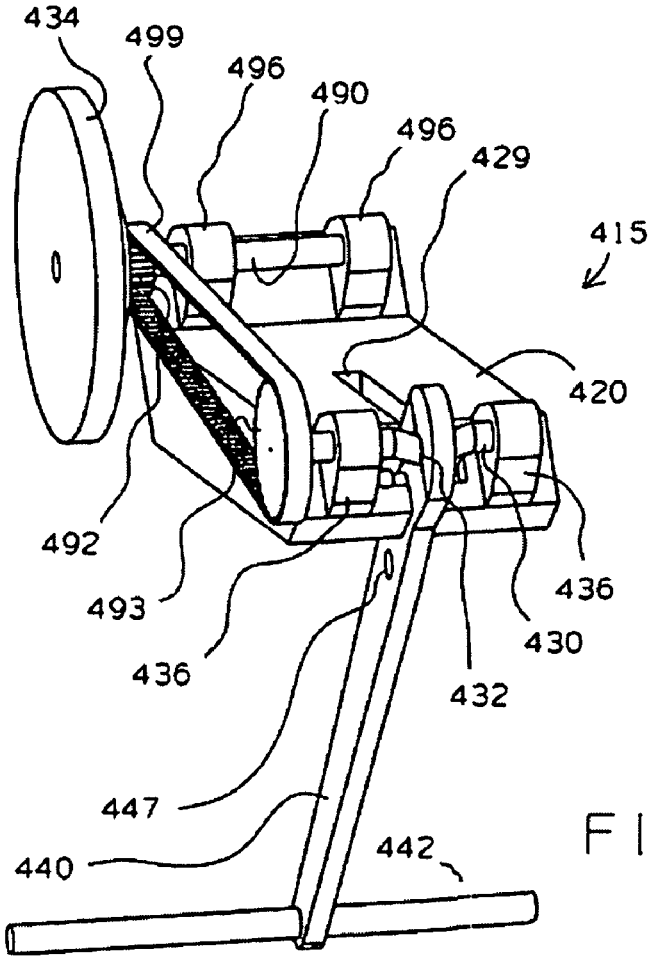
FIG. 18 is a perspective view of another exercise apparatus.
Figure 19:
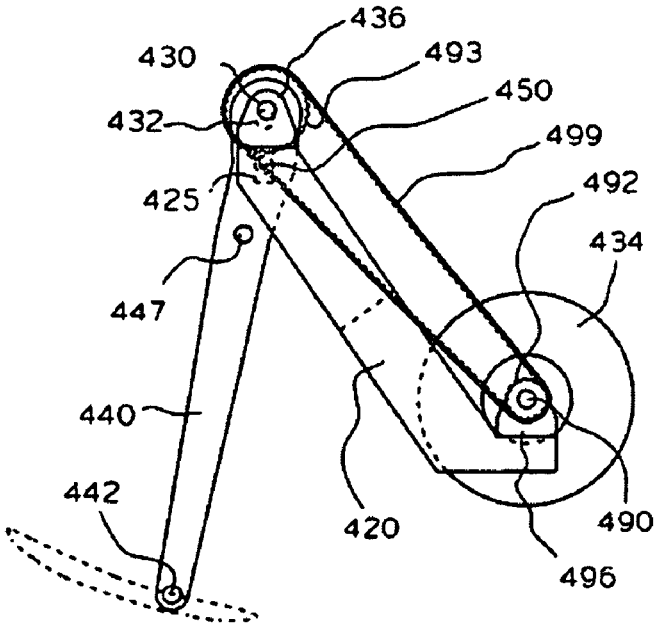
FIG. 19 is a side view of the exercise apparatus of FIG. 18.

Another exercise apparatus that can be adapted to employ the present invention is designated as 415 in FIGS. 18-19. Exercise apparatus 415 has a frame 420 which supports a linkage assembly. As in the foregoing exercise apparatus, the linkage assembly links rotation of a flywheel 434 to generally elliptical movement of a force receiving member 442.

The linkage assembly includes a camshaft 430 which is rotatably mounted on the frame 420 by means of bearing assemblies 436. A relatively large diameter sprocket 493 is mounted on the camshaft 430 and rotates together therewith about a camshaft axis relative to the frame 420. A first link 440 has an upper portion which is rotatably mounted on an eccentric portion 432 of the camshaft 430. This step in the assembly process may be performed by separating the first link 440 into two discrete parts along the line shown intersecting the eccentric portion 432 in FIG. 18. The link 440 rotates about a discrete axis relative to the eccentric portion 432, which in turn, rotates about the camshaft axis. The foot receiving element 442 is mounted on an opposite, lower end of the first link 440. A hole 447 is formed through the first link 440 to receive an optional hand receiving element with or without intermediate linkage components (like those on exercise apparatus 15).

The sprocket 493 is connected to a relatively small diameter sprocket 492 by means of a continuous belt 499. The sprocket 492 rotates together with the flywheel 434 relative to the frame 420. The flywheel shaft 490 is rotatably mounted to the frame 420 by means of bearing assemblies 496. Those skilled in the art will recognize this arrangement as a "stepped up" flywheel assembly which adds inertia to the system.

A bearing member 450 projects laterally outward from opposite sides of the first link 440 and into grooves 425 provided in opposing portions of the frame 420. The bearing member 450 travels along the grooves 425 during rotation of the camshaft 430 and limits movement of the first link 440 relative to the frame 420 accordingly. The bearing member 450 may be provided with a non-circular or "cammed" profile, and/or the grooves 425 may be provided with non-linear or "cammed" profiles, in order to impose desired characteristics on the motion of the first link 440. A slot 429 in the frame 420 provides clearance for the link 440 as it cycles.

Figure 20:
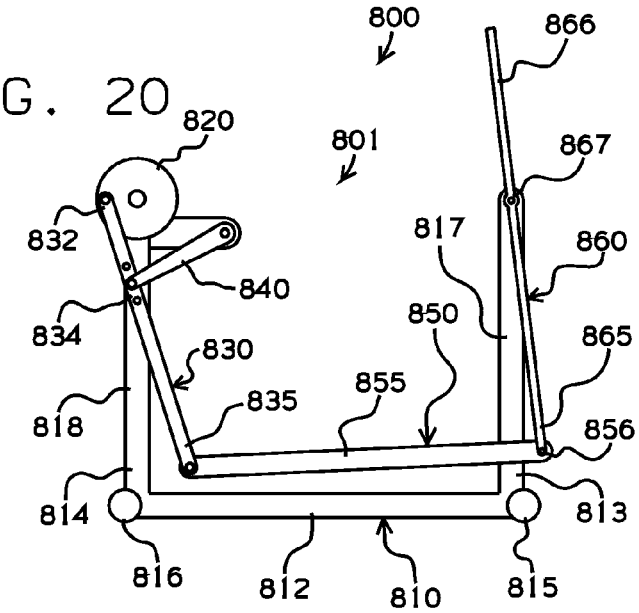
FIG. 20 is a side view of another exercise apparatus.

Another exercise apparatus that may be adapted to implement the principles of the present invention is designated as 800 in FIG. 20. Exercise apparatus 800 generally includes a linkage assembly 801 which moves relative to a frame 810 in a manner that links rotation of a crank 820 to generally elliptical motion of a force receiving member 850. The term "elliptical motion" is intended in a broad sense to describe a closed path of motion having a relatively longer first axis and a relatively shorter second axis (which is perpendicular to the first axis).

The frame 810 generally includes a base 812 which extends from a forward end 813 to a rearward end 814. A relatively forward transverse support 815 and a relatively rearward transverse support 816 cooperate to stabilize exercise apparatus 800 relative to a horizontal floor surface. A first stanchion or upright support 817 extends upward from the base 812 proximate its forward end 813. A second stanchion or upright support 818 extends upward from the base 812 proximate its rearward end 814.

Exercise apparatus 800 is generally symmetrical about a vertical plane extending lengthwise through the base 812 (perpendicular to the transverse ends 815 and 816 thereof), the primary exception being the diametrically opposed linkage assembly components on opposite sides of the plane of symmetry. Like reference numerals are used to designate both the "right-hand" parts and the "left-hand" parts on exercise apparatus 800, and when reference is made to one or more parts on only one side of the exercise apparatus, it is to be understood that corresponding part(s) are disposed on the opposite side. Those skilled in the art will also recognize that the portions of the frame 810 which are intersected by the plane of symmetry exist individually and thus, do not have any "opposite side" counterparts.

The linkage assembly 801 generally includes left and right cranks 820, left and right first links 830, left and right second links or rocker links 840, left and right third links or foot supporting links 850, and left and right fourth links or rocker links 860. On each side of exercise apparatus 800, a crank 820 is rotatably mounted to the rear stanchion 818 via a common shaft. In exercise apparatus 800, each crank 820 is a flywheel which is rigidly secured to the crank shaft, so that each crank 820 rotates together with the crank shaft relative to the frame 810. The flywheels 820 add inertia to the linkage assembly 801, and a drag strap or other known device may be connected to at least one of the flywheels 820 to provide an element of resistance.

An upper distal end 832 of each first link 830 is rotatably connected to a respective crank 820. As a result of this arrangement, the first link 830 is rotatable relative to the crank 820 and thereby defines an axis of rotation which, in turn, is rotatable about the crank shaft or crank axis. Each first link 830 has an intermediate portion 834 which is rotatably connected to a respective second link 840. Each first link 830 has an opposite, second distal portion 835 which is rotatably connected to a rearward end of a respective third link 850.

Each second link 840 is rotatably interconnected between the stanchion 818 and a respective first link 830 and may be described as a rocker link. As part of an optional adjustment feature, each second link 840 may be secured in any of a plurality of positions along the intermediate portion 834 of a respective first link 830. In particular, a fastener is inserted through any of several holes in the first link 830 and an aligned hole in the second link 840. Those skilled in the art will recognize that various known fasteners, such as a snap button or a detent pin, may be used to make the adjustable connection. As a result of the interconnection between the first link 830 and the second link 840, the first link 830 pivots relative to the second link 840 and thereby defines an axis of rotation which, in turn, pivots relative to the stanchion 818. In other words, the intermediate portion 834 of the first link 830 is constrained to move in reciprocating fashion relative to the stanchion 818.

Each third link 850 is rotatably interconnected between a respective first link 830 and a respective fourth link 860. Since the first links 830 are linear in exercise apparatus 800, the three rotational axes associated therewith lie within a single plane (which extends perpendicular to the drawing sheet of FIG. 20). Each third link 850 has an intermediate portion 855 which is sized and configured to support a person's foot. In this regard, each third link 850 may be described as a force receiving means and/or a foot supporting member. Each third link 850 has an opposite, forward end 856 which is rotatably connected to a lower end 865 of a respective fourth link 860.

An intermediate portion 867 of each fourth link 860 is rotatably connected to the forward stanchion 817. As a result of this arrangement, each third link 850 pivots relative to a respective fourth link 860 and thereby defines an axis of rotation which, in turn, pivots relative to the frame 810. In other words, each fourth link 860 is rotatably interconnected between a respective third link 850 and the frame 810 and may be described as a rocker link and/or as a means for constraining the forward end 856 of the third link 850 to move in reciprocating fashion relative to the frame 810. An opposite, upper end 866 of each fourth link 860 is sized and configured for grasping by a person standing on the foot supports 855. In this regard, each fourth link 860 may be described as a force receiving means and/or a hand supporting member.

To use exercise apparatus 800, a person stands with a respective foot on each of the foot supports 855 and begins moving his or her feet in striding fashion. The linkage assembly 801 constrains the person's feet to move through elliptical paths while the cranks 820 rotate relative to the frame 810. The point of interconnection between the first link 830 and the second link 840 may be moved along the length of the former in order to adjust the foot path. The handles 866 move in reciprocal fashion during rotation of the cranks 820, so that the person may exercise his or her arms simply by grasping a respective handle 866 in each hand. In the alternative, the person may simply balance during leg exercise and/or steady himself or herself relative to a stationary support (not shown) on the frame 810.

Exercise apparatus 800 may be modified in a number of ways without departing from the scope of the present invention. For example, the rocker links 860 could be replaced by rollers mounted on the forward ends of the foot supporting links 850 and in rolling contact with a ramp or tracks mounted on the frame. Furthermore, the rearward stanchion 818 could be altered so that the axis defined between the rockers 840 and the stanchion 818 would be disposed behind the crank axis. Moreover, an upper portion of the rear stanchion could be pivotally mounted to a lower portion thereof and selectively moved relative thereto in order to adjust the foot path. The cranks 820 could be replaced by crank arms and "stepped-up" flywheel and/or supplemented with a drag strap or other known resistance device to provide momentum and/or resistance to exercise movement. Such exercise apparatus could also be modified so that the rocker axis is oriented differently and/or selectively movable relative to the crank axis.

Figure 21:
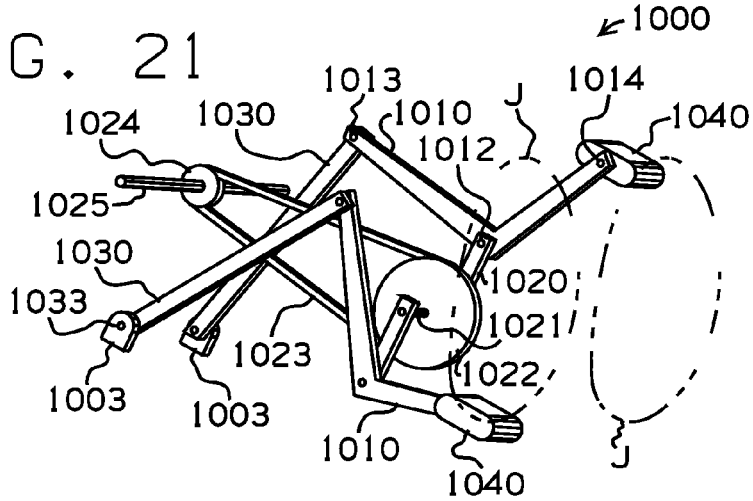
FIG. 21 is a perspective view of another exercise apparatus.
Figure 22:
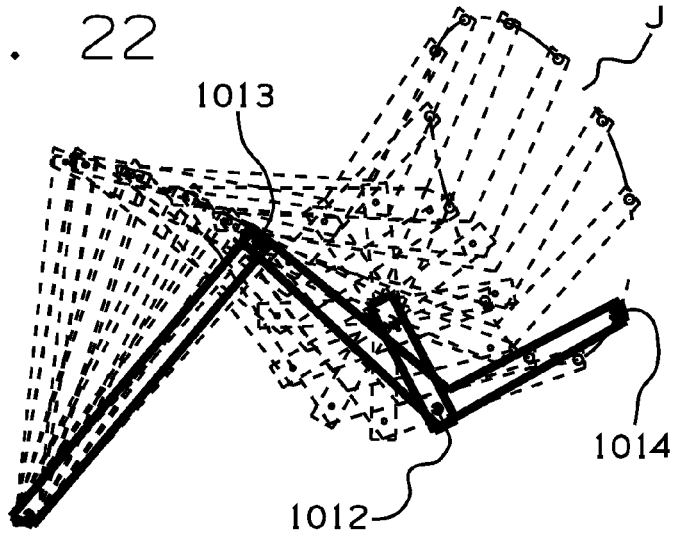
FIG. 22 is a side view of the linkage assembly on the exercise apparatus of FIG. 21, with the linkage members depicted at different times during an exercise cycle.

Another exercise apparatus constructed according to the principles of the present invention is designated as 1000 in FIGS. 21-22. Exercise apparatus 1000 generally includes a frame and a linkage assembly which moves relative to the frame in a manner that links rotation of left and right cranks to generally elliptical motion of left and right force receiving members.

The linkage assembly may be described in terms of connector links 1010 having three discrete connection points which may be described as three vertices of a triangle. The connector links 1010 maintain fixed distances between the connection points but is not necessarily triangular in shape. On exercise apparatus 1000, the connector links 1010 have first connection points 1012 which are rotatably connected to radially offset portions of respective cranks 1020; second connection points 1013 which are rotatably connected to distal ends of respective rocker links 1030; and third connection points 1014 which are rotatably connected to respective foot supporting members 1040. Opposite ends of the rocker links 1030 are rotatably connected to respective trunnions 1003 on the frame.

A first portion of each connector link 1010 extends in linear fashion between the first connection point 1012 and the second connection point 1013, and a second portion of each connector link 1010 extends in linear fashion between the first connection point 1012 and the third connection point 1014. Each connector link 1010 could be provided with a third portion which extends in linear fashion between the second connection point 1013 and the via third connection point 1014 (in addition to or in lieu of either other portion) without affecting the motion of the linkage assembly. FIG. 22 shows the connection points 1012-1014 at various points throughout an exercise cycle.

The cranks 1020 are keyed to a crank shaft 1021 together with a relatively large diameter pulley 1022. A belt 1023 connects the pulley 1022 to a relatively small diameter pulley 1024 which is keyed to a remote shaft 1025. The foot supports 1040 move through generally elliptical paths J, the crank shaft 1021 rotates at a first speed, and the remote shaft 1025 rotates at a second, relatively greater speed. The remote shaft 1025 is suitable for linking movement of the foot supports 1040 to movement of arm exercise members and/or rotation of a flywheel, which in turn, may be acted upon by a drag strap or other known resistance device. In the absence of one-way clutches or the like, the shafts 1021 and 1025 are free to rotate in either direction.

Figure 23A:
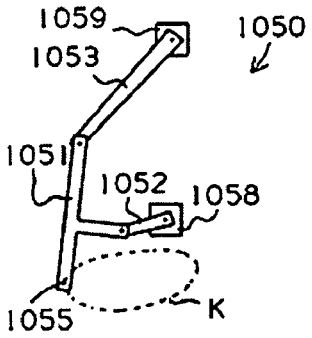
FIGS. 23*a*-23*e* are side views of five distinct linkage assemblies which produce generally elliptical exercise motion.

FIG. 23*a* shows a linkage assembly 1050 which is similar in many respects to that on exercise apparatus 1000. A connector link 1051 and a crank 1052 are rotatably interconnected to define a first connection point; the connector link 1051 and a rocker link 1053 are rotatably interconnected to define a second connection point; and the connector link 1051 and a foot support are rotatably interconnected to define a third connection point 1055. The T-shape configuration of the connector link 1051 maintains the three connection points in fixed relationship to one another.

A radially inward end of the crank 1052 is rotatably connected to a first frame member 1058, and a radially-inward end of the rocker link 1053 is rotatably connected to a second frame member 1059. The resulting linkage assembly 1050 links rotation of the crank 1052 to movement of the foot support through a path of motion K. The axes associated with the frame members 1058 and 1059 define a line therebetween which is approximately perpendicular to the major axis of the path K.

Figure 23B:
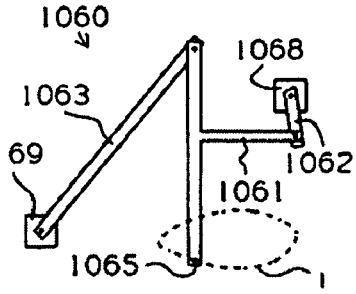

FIG. 23*b* shows a linkage assembly 1060 which is similar in some respects to the previous assembly 1050. A connector link 1061 and a crank 1062 are rotatably interconnected to define a first connection point; the connector link 1061 and a rocker link 1063 are rotatably interconnected to define a second connection point; and the connector link 1061 and a foot support are rotatably interconnected to define a third connection point 1065. The T-shape configuration of the connector link 1061 maintains the three connection points in fixed relationship to one another.

A radially inward end of the crank 1062 is rotatably connected to a first frame member 1068, and a radially inward end of the rocker link 1063 is rotatably connected to a second frame member 1069. The resulting linkage assembly 1060 links rotation of the crank 1062 to movement of the foot support through a path of motion L. The axes associated with the frame members 1068 and 1069 define a line therebetween which is approximately parallel to the major axis of the path L, and at least a portion of the connector link 1061 remains between said axes throughout an exercise cycle. Also, the arrangement and proportions of the linkage components allow a person's hand to rotate with the crank while the person's foot moves with the foot support.

Figure 23C:
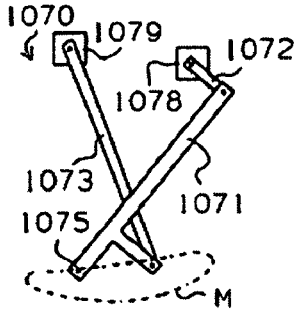

FIG. 23*c* shows a linkage assembly 1070 which is similar in some respects to the assemblies 1050 and 1060. A connector link 1071 and a crank 1072 are rotatably interconnected to define a first connection point; the connector link 1071 and a rocker link 1073 are rotatably interconnected to define a second connection point; and the connector link 1071 and a foot support are rotatably interconnected to define a third connection point 1075. The T-shape configuration of the connector link 1071 maintains the three connection points in fixed relationship to one another.

A radially inward end of the crank 1072 is rotatably connected to a first frame member 1078, and a radially inward end of the rocker link 1073 is rotatably connected to a second frame member 1079. The resulting linkage assembly 1070 links rotation of the crank 1072 to movement of the foot support through a path of motion M. The axes associated with the frame members 1078 and 1079 define a line therebetween which is approximately parallel to the major axis of the path M.

Figure 23D:
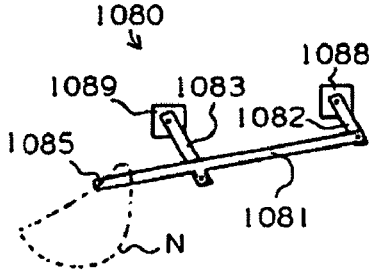

FIG. 23*d* shows a linkage assembly 1080 which is similar in some respects to the previous assembly 1070. A connector link 1081 and a crank 1082 are rotatably interconnected to define a first connection point; the connector link 1081 and a rocker link 1083 are rotatably interconnected to define a second connection point; and the connector link 1081 and a foot support are rotatably interconnected to define a third connection point 1085. The substantially linear connector link 1081 maintains the three connection points in fixed relationship to one another.

A radially inward end of the crank 1082 is rotatably connected to a first frame member 1088, and a radially inward end of the rocker link 1083 is rotatably connected to a second frame member 1089. The resulting linkage assembly 1080 links rotation of the crank 1082 to movement of the foot support through a path of motion N. The axes associated with the frame members 1088 and 1089 define a line therebetween which is approximately parallel to the major axis of the path N.

Figure 23E:
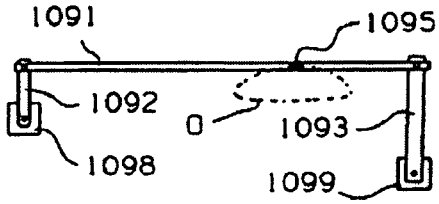

FIG. 23*e* shows a linkage assembly 1090 which is similar in some respects to the previous assembly 1080. A connector link 1091 and a crank 1092 are rotatably interconnected to define a first connection point; the connector link 1091 and a rocker link 1093 are rotatably interconnected to define a second connection point; and the connector link 1091 and a foot support are rotatably interconnected to define a third connection point 1095. The substantially linear connector link 1091 maintains the three connection points in fixed relationship to one another.

A radially inward end of the crank 1092 is rotatably connected to a first frame member 1098, and a radially inward end of the rocker link 1093 is rotatably connected to a second frame member 1099. The resulting linkage assembly 1090 links rotation of the crank 1092 to movement of the foot support through a path thy, of motion M. The axes associated with the frame members 1098 and 1099 define a line therebetween which is approximately parallel to the major axis of the path O.

Figure 24:
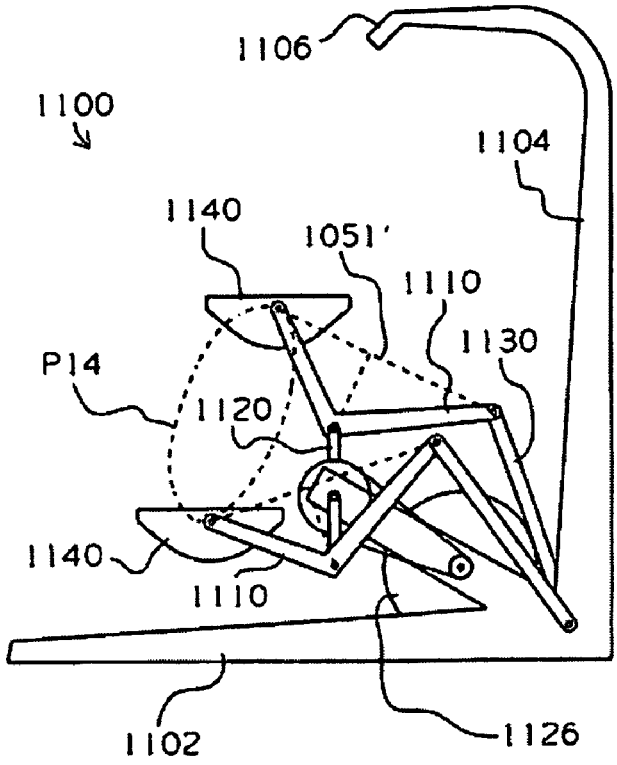
FIGS. 24-26 are side views of other exercise apparatuses.

FIG. 24 shows a "stand up" exercise apparatus 1100 having a linkage assembly similar to that designated as 1050 in FIG. 23*a*. The exercise apparatus frame includes a base 1102 designed to rest upon a floor surface; a forward stanchion 1104 extending upward from the base 1102; and fixed handle bars 1106 extending rearward from an upper end of the stanchion 11104.

Crank arms 1120 are rotatably mounted relative to the frame and operatively connected to a "stepped up" flywheel 1126. Radially displaced ends of the crank arms 1120 are connected to respective connector links 1110. The dashed lines designated as 1051' are included in FIG. 24 to suggest an alternative connector link configuration. Rocker links 1130 are movably interconnected between the frame and respective connector links 1110. Foot supports 1140 are connected to respective connector links 1110.

Rotation of the crank arms 1120 is linked to reciprocal pivoting of the rocker links 1130 and movement of the foot supports 1140 through generally elliptical paths of motion designated as P14. The foot supports 1140 are preferably connected to the connector links 1110 in a manner which allows rotation of the former approximately nineteen degrees in either direction relative to the latter. An alternative way to facilitate "leveling" of the foot supports is to suspend them from the connector links 1110, so that a user's weight tends to remain under center of the rotational axis defined between the foot support and the connector link.

Figure 25:
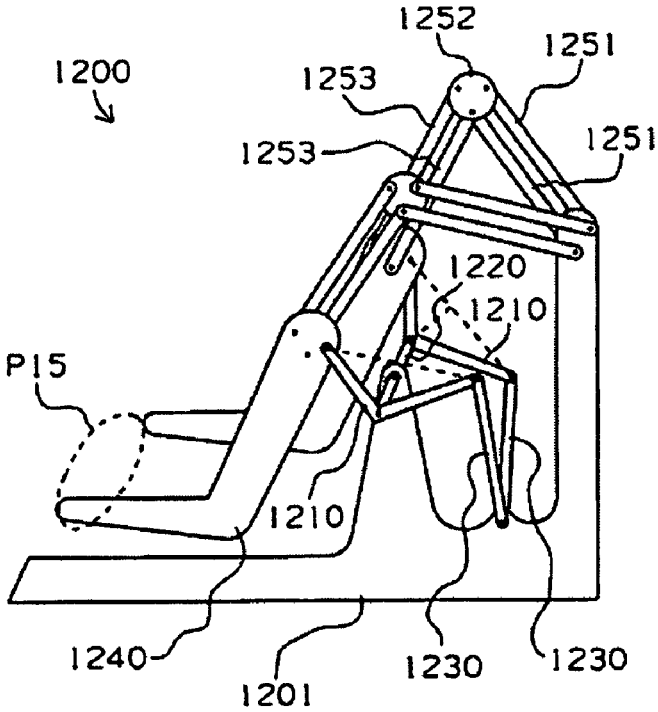

FIG. 25 shows another "stand up" exercise apparatus 1200 which is similar in many respects to exercise apparatus 1100. Connector links 1210 have first portions connected to respective crank arms 1220; second portions connected to respective rocker links 1230; and third portions connected to respective foot supports 1240. Rotation of the crank arms 1220 relative to the frame 1201 is linked to reciprocal pivoting of the rocker links 1230 and movement of the foot supports 1240 through generally elliptical paths of motion designated as P15.

The foot supports 1240 are maintained in level orientations by means of guide linkages movably interconnected between the foot supports 1240 and the frame 1201. Each guide linkage includes a first pair of parallel bars 1251 rotatably interconnected between the frame 1201 and a plate 1252, and a second pair of parallel bars 1253 rotatably interconnected between the plate 1252 and a respective foot support 1240.

Figure 26:
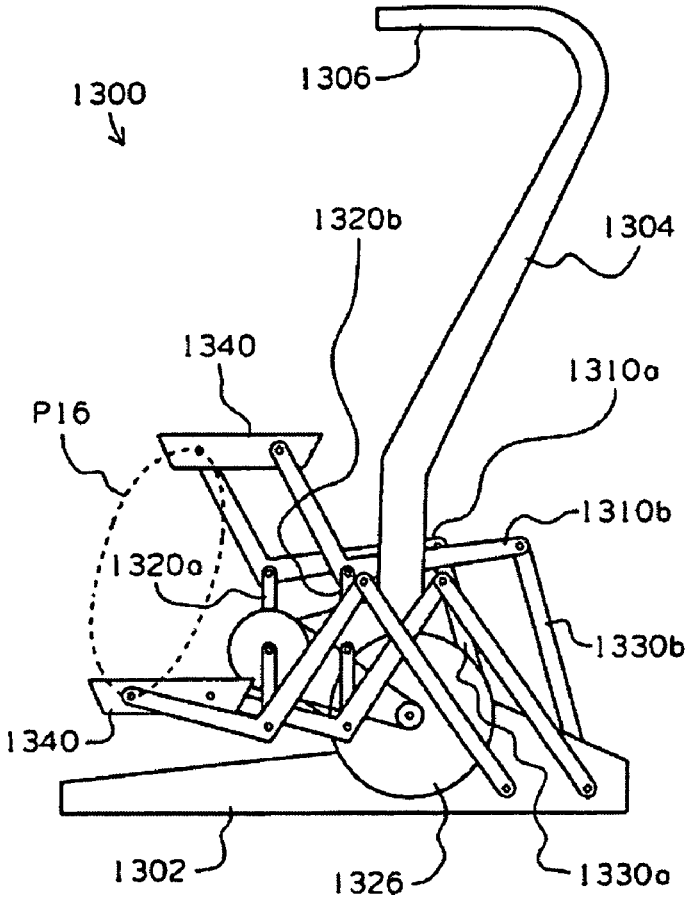

FIG. 26 shows another "stand up" exercise apparatus 1300 which is similar in many respects to exercise apparatus 1100 and 1200. The exercise apparatus frame includes a base 1302 designed to rest upon a floor surface; a stanchion 1304 extending upward from the base 1302; and fixed handle bars 1306 extending rearward from an upper end of the stanchion 1304.

On each side of exercise apparatus 1300, first and second connector links 1310*a* and 1310*b* have first portions connected to respective first and second crank arms 1320*a* and 1320*b*; second portions connected to respective first and second rocker links 1330*a* and 1330*b*; and third portions connected to a respective foot support 1340. Rotation of the crank arms 1320*a* and 1320*b* relative to the frame is linked to reciprocal pivoting of the rocker links 1330*a* and 1330*b* and movement of the foot supports 1340 through generally elliptical paths of motion designated as P16. The rocker links 1330 pivot through a range of approximately 36 degrees and are within eleven degrees of their forwardmost orientation when a respective foot platform 1340 reaches its apex. The foot supports 1340 are maintained in level orientations by means of the dual linkage assemblies associated with each foot support 1340. At least one of the crank arms 1320*a* and 1320*b* is operatively connected to a "stepped up" flywheel 1326.

Figure 27:
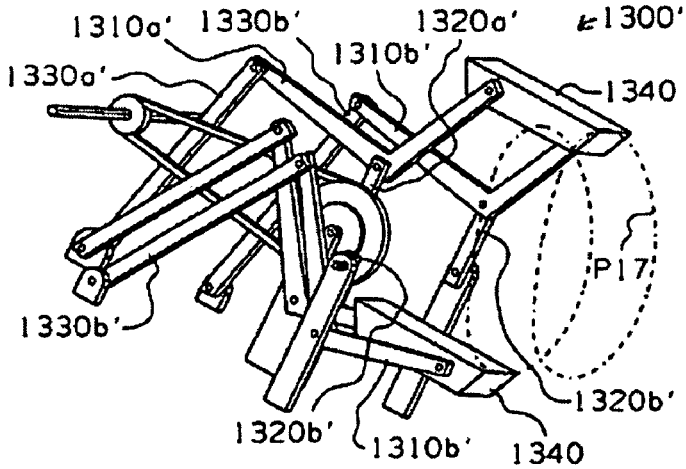
FIG. 27 is a perspective view of the linkage assembly on the exercise apparatus of FIG. 26.

FIG. 27 shows a linkage assembly 1300' which is similar in many respects to that on exercise apparatus 1300. On each side of the assembly 1300', first and second connector links 1310*a*' and 1310*b*' have first portions connected to respective first and second crank arms 1320*a*' and 1320*b*'; second portions connected to respective first and second rocker links 1330*a*' and 1330*b*'; and third portions connected to a respective foot support 1340. Rotation of the crank arms 1320*a*' and 1320*b*' relative to the frame is linked to reciprocal pivoting of the rocker links 1330*a*' and 1330*b*' and movement of the foot supports 1340 through generally elliptical paths of motion designated as P17. Although the crank arms 1320*b*' are not keyed to a common shaft, they are still constrained to rotate in synchronous fashion.

Figure 28:
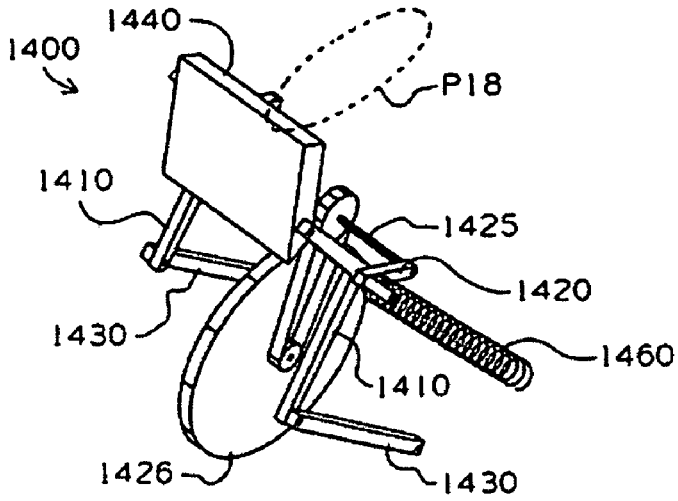
FIG. 28 is a perspective view of another exercise apparatus constructed according to the principles of the present invention.

FIG. 28 shows a linkage assembly 1400 which is similar in some respects to the previous assembly 1300'. First and second connector links 1410 have first portions connected to respective first and second crank arms 1420; second portions connected to respective first and second rocker links 1430; and third portions connected to a foot support 1440. Rotation of the crank arms 1420 relative to the frame is linked to reciprocal pivoting of the rocker links 1430 and movement of the foot support 1440 through a generally elliptical path of motion designated as P18.

The foot support 1440 is maintained in a constant orientation relative to the frame by offsetting the rotational axes and connection points on one side of the assembly 1400 relative to those on the other side of the assembly 1400. Although the crank arms 1420 are not keyed to a common shaft, they are still constrained to rotate in synchronous fashion.

The foot support 1440 is sized and configured to accommodate both feet of a user seated and facing toward the foot support 1440, and the linkage assembly 1400 is designed to provide a leg press type exercise motion. A "stepped up" flywheel 1426 is connected to a crank shaft 1425 to add inertia to the assembly 1400, and a spring 1460 is disposed in compression between the frame and the first portion of a connector link 1410 to bias the foot support 1440 toward the user. Similar springs could be used on other exercise apparatuses in addition to or in lieu of a flywheel.

Figure 29:
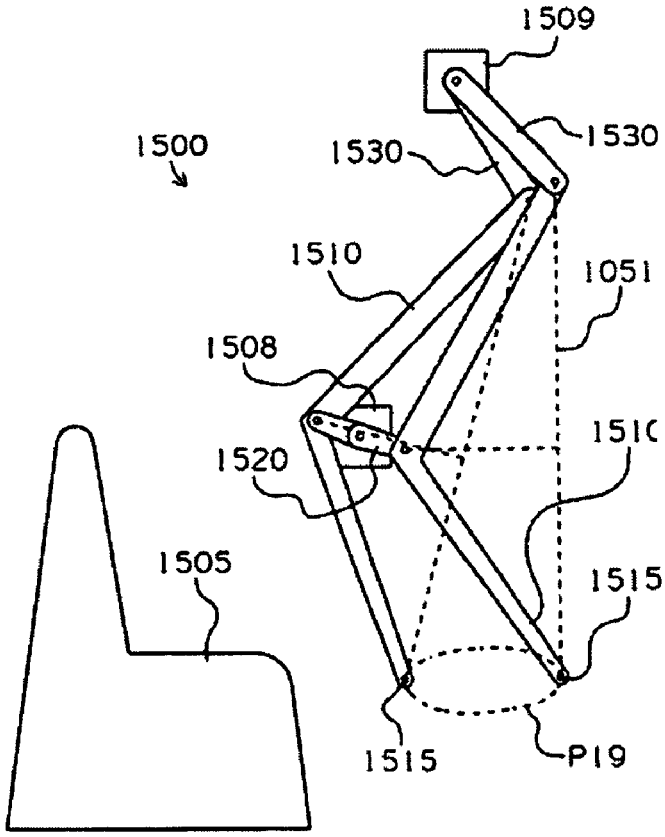
FIGS. 29-34 are side views of other exercise apparatuses.

FIG. 29 shows another "sit down" exercise apparatus 1500 which includes a chair 1505 and a linkage assembly similar to that shown in FIG. 23*a*. Connector links 1510 have first portions connected to respective crank arms 1520; second portions connected to respective rocker links 1530; and third portions connected to respective foot supports at connection points 1515. A radially inward end of each crank 1520 is rotatably connected to a first frame member 1508, and a radially inward end of the rocker link 1530 is rotatably connected to a second frame member 1509. The resulting linkage assembly links rotation of the crank arms 1520 relative to the frame to pivoting of the rocker links 1530 and movement of the foot support connection points 1515 through generally elliptical paths of motion designated as P19. The dashed lines 1051" suggest an alternative configuration for the connector links 1510. On exercise apparatus like exercise apparatus 1500, where the crank arms are keyed to a common shaft, a flywheel could be substituted for the crank arms, and the connector links could be rotatably connected directly to diametrically opposed points on the flywheel.

Figure 30:
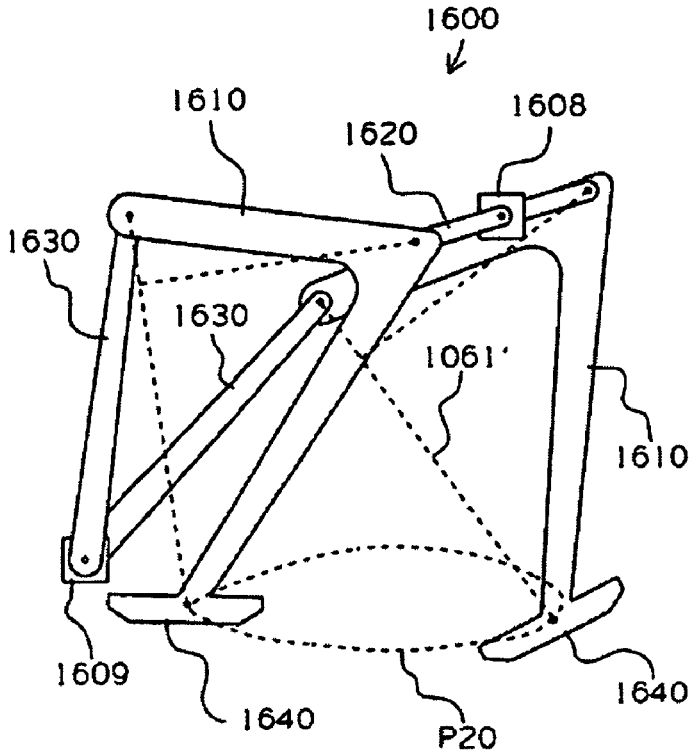

FIG. 30 shows a "stand up" exercise apparatus 1600 having a linkage assembly which is similar in many respects to that shown in FIG. 23*b*. Connector links 1610 have first portions connected to respective crank arms 1620; second portions connected to respective rocker links 1630; and third portions connected to respective foot supports 1640. A radially inward end of each crank 1620 is rotatably connected to a first frame member 1608, and a radially inward end of the rocker link 1630 is rotatably connected to a second frame member 1609. The resulting linkage assembly links rotation of the crank arms 1620 relative to the frame to pivoting of the rocker links 1630 and movement of the foot supports 1640 through generally elliptical paths of motion designated as P20. The foot supports 1640 are rigidly secured to the connector links 1610 and change orientations during the exercise cycle. The dashed lines 1061' suggest an alternative configuration for the connector links 1610.

Figure 31:
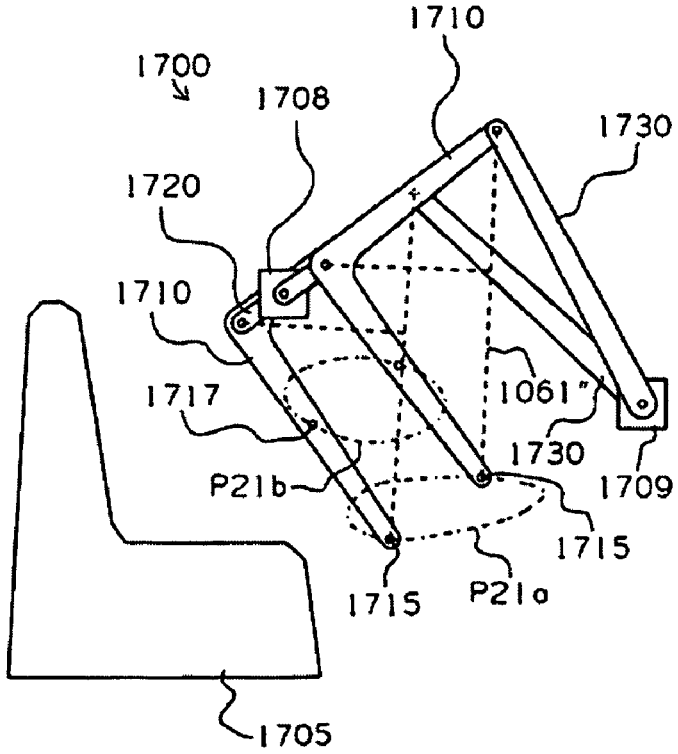

FIG. 31 shows another "sit down" exercise apparatus 1700 which includes a chair 1705 and a linkage assembly similar to that shown in FIG. 23*b*. Connector links 1710 have first portions connected to respective crank arms 1720; second portions connected to respective rocker links 1730; and third portions connected to respective foot supports at connection points 1715. A radially inward end of each crank 1720 is rotatably connected to a first frame member 1708, and a radially inward end of the rocker link 1730 is rotatably connected to a second frame member 1709. The resulting linkage assembly links rotation of the crank arms 1720 relative to the frame to pivoting of the rocker links 1730 and movement of the foot support connection points 1715 through generally elliptical paths of motion designated as P21*a*. The dashed lines 1061" suggest an alternative configuration for the connector links 1710.

Optional fourth connection points 1717 are provided on the connector links 1710 to receive handles and direct them through generally elliptical paths of motion designated as P21*b*. In this regard, the present invention may be seen to provide elliptical motion exercise for both the lower body and the upper body. In a preferred mode of operation, a person pulls against a handle when it occupies a relatively low position along the path P21*b*, and a person pushes against a foot support when it occupies a relatively high position along the path P21*a*. In other words, the user may pull with his left hand while pushing with his right leg and then pull with his right hand while pushing with his left leg.

Handles may be connected to connector links on some of the other exercise apparatuses, as well. For example, an exercise apparatus with a single, relatively larger foot support (like that shown in FIG. 28) could facilitate exercise wherein a person pulls with both arms during a "lower" one-half of an exercise cycle and subsequently pushes with both legs during an "upper" one-half of the exercise cycle. Contrary to conventional rowing exercisers, such an exercise apparatus exercises the upper body and lower body at different times in the exercise cycle (approximately 180 degrees out of phase) and maintains relatively continuous motion.

Figure 32:
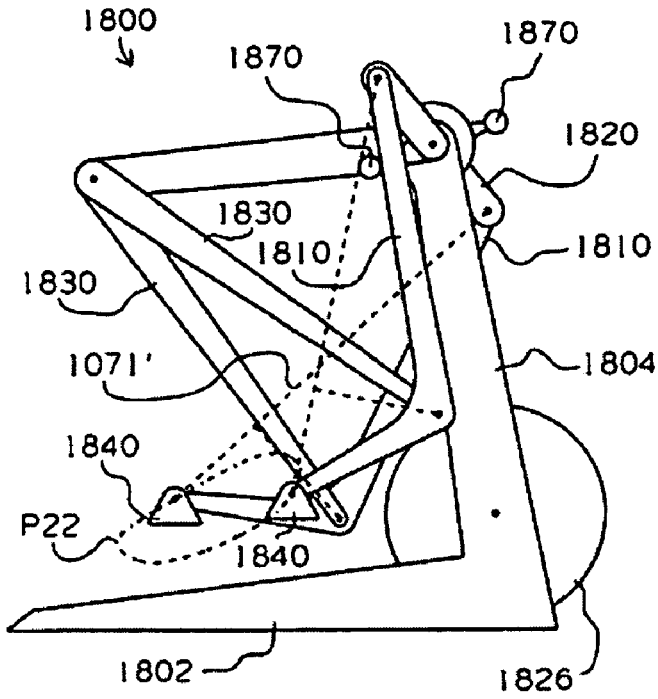

FIG. 32 shows a "stand up" exercise apparatus 1800 having a linkage assembly similar to that shown in FIG. 23*c*. The exercise apparatus frame includes a base 1802 designed to rest upon a floor surface, and a stanchion 1804 extending upward from the base 1802.

On each side of exercise apparatus 1800, a connector link 1810 has a first portion connected to a respective crank arm 1820; a second portion connected to a respective rocker link 1830; and a third portion connected to a respective foot support 1840. Rotation of the crank arms 1820 relative to the frame is linked to pivoting of the rocker links 1830 and movement of the foot supports 1840 through generally elliptical paths of motion designated as P22. The dashed lines 1071' suggest an alternative configuration for the connector links 1810. The foot supports 1840 are suspended from the connector links 1810 and therefore "self-leveling" relative to the underlying ground surface.

Optional handles 1870 are rotatably mounted on the stanchion 1804 within reach of a person standing on the foot supports 1840. Rotation of the handles 1870 is linked to rotation of the cranks 1820 to facilitate contemporaneous exercise of the lower body and the upper body. An optional "stepped up" flywheel 1826 may be operatively connected to the cranks 1820 to add inertia to the linkage assembly.

Figure 33:
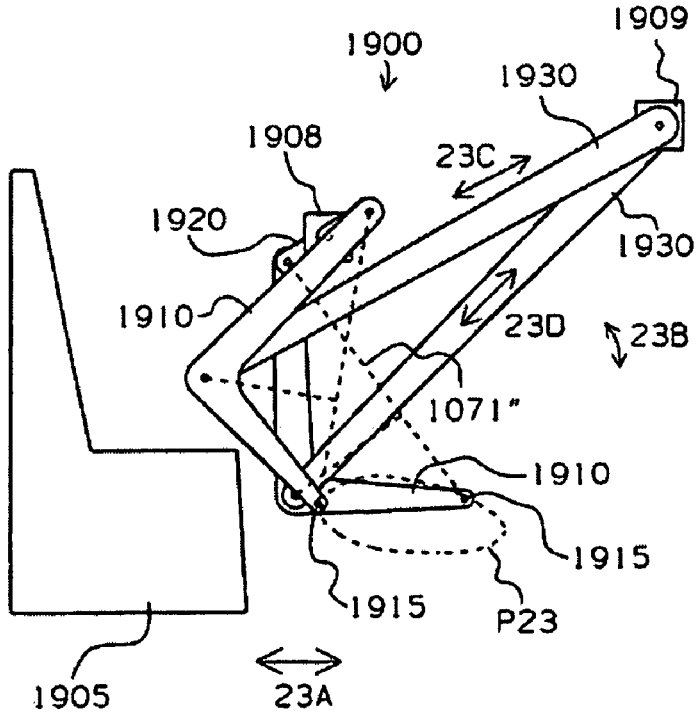

FIG. 33 shows another "sit down" exercise apparatus 1900 which includes a chair 1905 and a linkage assembly similar to that shown in 23*c*. Connector links 1910 have first portions connected to respective crank arms 1920; second portions connected to respective rocker links 1930; and third portions connected to respective foot supports at connection points 1915. A radially inward end of each crank 1920 is rotatably connected to a first frame member 1908, and a radially inward end of the rocker link 1930 is rotatably connected to a second frame member 1909. The resulting linkage assembly links rotation of the crank arms 1920 relative to the frame to pivoting of the rocker links 1930 and movement of the foot support connection points 1915 through generally elliptical paths of motion designated as P23. The dashed lines 1071" suggest an alternative configuration for the connector links 1910.

Optional handles may be connected to the crank arms 1920 (at the first connection points on the connector links 1910 or at discrete locations) to facilitate upper body exercise, as well as lower body exercise. Adjustments may be made to exercise apparatus 1900 or other exercise apparatuses to optimize motion of the handles and/or the foot supports relative to a seated user. For example, the distance between the user and the linkage assembly may be adjusted by moving the seat 1905 relative to the linkage assembly (as suggested by the arrows 23A); the orientation of the elliptical paths P23 relative to the user may be adjusted by rotating the frame relative to the seat 1905 (as suggested by the arrows 23B); and/or the configuration of the elliptical paths P23 may be adjusted by changing the distance between the frame members 1908 and 1909 (as suggested by the arrows 23C), and/or by changing the length of one or more of the linkage assembly components (as suggested by the arrows 23D). A common way to make adjustments of this sort involves provision of at least one hole in a member on one side of the adjustment; provision of multiple holes in a member on the other side of the adjustment; and insertion a fastener through an aligned pair of holes. For example, each rocker link 1930 might include first and second telescoping members which are selectively fixed relative to one another by means of a detent pin.

Additional methods may also be described with reference to the foregoing exercise apparatus 1900. For example, the present invention may be seen to provide various methods of exercise, comprising the steps of interconnecting a crank between a first frame member and a first connection point on a rigid link; constraining a second connection point on the rigid link to move in reciprocal fashion relative to a second frame member; connecting a foot support to a third connection point on the rigid link; and moving the resulting linkage assembly relative to a seat, rotating the frame members relative to a seated user, changing the distance between the frame members, and/or changing the length of one or more linkage assembly components.

Figure 34:
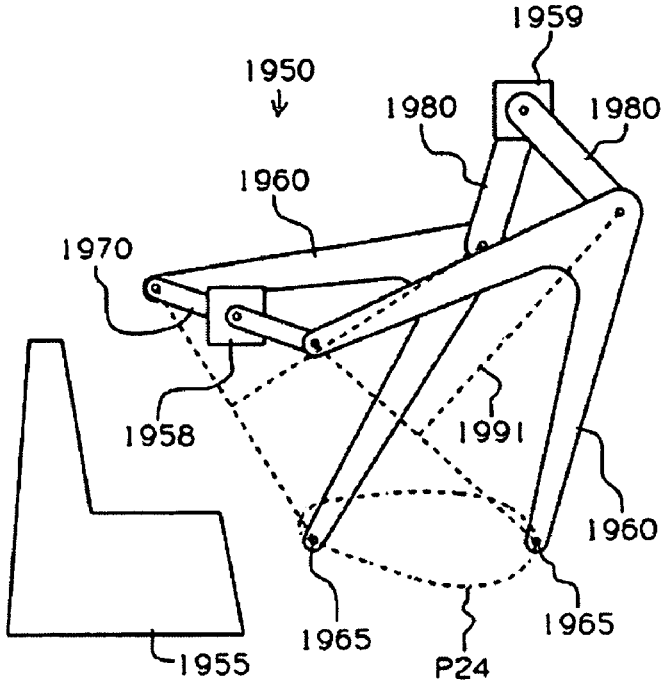

FIG. 34 shows another "sit down" exercise apparatus 1950 which includes a chair 1955 and a connector link 1960 having connection points similar to those on the assembly shown in FIG. 23*c* but a dashed line representation 1991 more comparable to the assembly shown in FIG. 23*a*. In any event, connector links 1960 have first portions connected to respective crank arms 1970; second portions connected to respective rocker links 1980; and third portions connected to respective foot supports at connection points 1965. A radially inward end of each crank 1970 is rotatably connected to a first frame member 1958, and a radially inward end of the rocker link 1980 is rotatably connected to a second frame member 1959. The resulting linkage assembly links rotation of the crank arms 1970 relative to the frame to pivoting of the rocker links 1980 and movement of the foot support connection points 1965 through generally elliptical paths of motion designated as P24. Like on previously described exercise apparatuses, handles may be connected to the crank arms 1970, and/or adjustments may be made to the linkage assembly and/or its relationship to the chair 1955.

Figure 35:
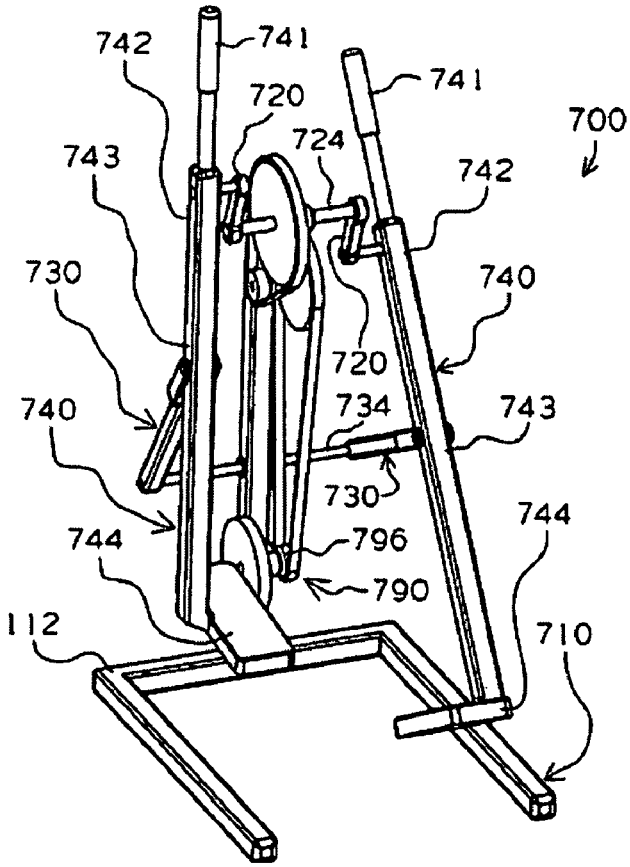
FIG. 35 is a perspective view of another exercise apparatus.
Figure 36:
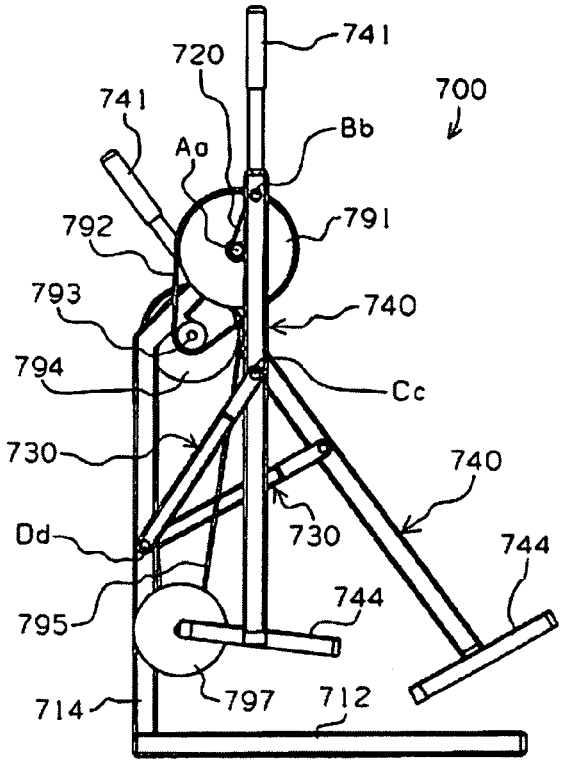
FIG. 36 is a side view of the exercise apparatus of FIG. 35, FIGS. 37 and 38 are side views of other exercise apparatuses.

Yet another exercise apparatus constructed according to the principles of the present invention is designated as 700 in FIGS. 35-36. Exercise apparatus 700 generally includes a linkage assembly which moves relative to the frame 710 in a manner that links rotation of crank(s) 720 to generally elliptical motion of force receiving member(s) 741 or 744. The frame 710 includes a generally U-shaped base 712 which rests upon a floor surface. A forward stanchion 714 extends upward from the base 712 and supports the crank(s) 720 and the linkage assembly.

Exercise apparatus 700 is generally symmetrical about a vertical plane extending lengthwise through the frame 710, the only exceptions being an inertia altering system 790 and the relative orientation of certain parts of the linkage assembly on opposite sides of the plane of symmetry. In exercise apparatus 700, the "right-hand" components are one hundred and eighty degrees out of phase relative to the "left-hand" components. However, like reference numerals are used to designate both the "right-hand" and "left-hand" parts on exercise apparatus 700, and when reference is made to one or more parts on only one side of the exercise apparatus, it is to be understood that corresponding part(s) are disposed on the opposite side of exercise apparatus 700. Those skilled in the art will also recognize that the portions of the frame 710 which are intersected by the plane of symmetry, as well as the components of the inertia system 790, exist individually and thus, do not have any "opposite side" counterparts.

On each side of exercise apparatus 700, a crank 720 is rotatably mounted to the stanchion 714 via a common shaft 724. In particular, each crank 720 has a first end which is rigidly secured to the crank shaft 724, so that each crank 720 rotates together with the crank shaft 724 relative to the frame 710. Each crank 720 has a second, opposite end which rotates about an axis Aa (shown in FIG. 36) and thereby defines a crank radius.

The inertia altering system 790 includes a relatively large diameter pulley 791 which is rigidly secured to the crank shaft 724 and rotatable about the axis Aa. A closed loop or belt 792 connects the large pulley 791 to a relatively small diameter pulley 793 which rotates (together with another large diameter pulley 794 and a discrete shaft) relative to the frame 710. A second, longer belt 795 connects the second large pulley 794 to a second small diameter pulley 796 which rotates (together with a flywheel 797 and another discrete shaft) relative to the frame 710. The result is a "stepped-up" flywheel 797 which rotates faster than the crank shaft 724 and the cranks 720. Other inertia altering devices, such as a frictional drag strap, may be added to or substituted for the flywheel arrangement to provide momentum and/or resistance to exercise movement.

The opposite end of each crank 720 is rotatably connected to an intermediate portion 742 of a respective main link 740. As a result of this arrangement, the first link 740 is rotatable about an axis Bb (shown in 36) relative to the crank 720. The axis Bb is disposed at a fixed distance or crank radius from the axis Aa and is rotatable about the axis Aa. In other words, the crank 720 may be described as a means for constraining a portion 742 of the main link 740 to rotate relative to the frame 710.

Each first link 740 has a relatively lower intermediate portion 743 which is rotatably connected to an end of a respective rocker link 730. An opposite end of each rocker link 730 is rotatably connected to the stanchion 714 at axis Dd (shown in FIG. 36). As a result of this arrangement, the first link 740 is rotatable about an axis Cc (shown in FIG. 36) relative to the rocker link 730. The axis Cc is disposed at a fixed distance from the axis Dd and is rotatable about the axis Dd. In other words, the rocker link 730 may be described as a means for constraining a portion 743 of the main link 740 to move in reciprocal fashion relative to the frame 710.

Each first link 740 has an upper distal end 741 which is sized and configured for grasping, and a lower distal end 744 which is sized and configured to support a discrete foot of a standing person. Both ends 741 and 744 are constrained to move through a generally elliptical path of motion in response to rotation of the cranks 720 and pivoting of the rocker links 730.

Those skilled in the art will recognize additional embodiments, modifications, and/or applications involving exercise apparatus 700. For example, the exercise motion could be adjusted by providing telescoping cranks and/or rocker links with holes that align to receive fasteners in more than one location, and/or by adjusting the location of the rocker axis relative to the frame. Moreover, the size, configuration, and/or arrangement of the components of the foregoing embodiment 700 may be modified as a matter of design choice.

Figure 37:
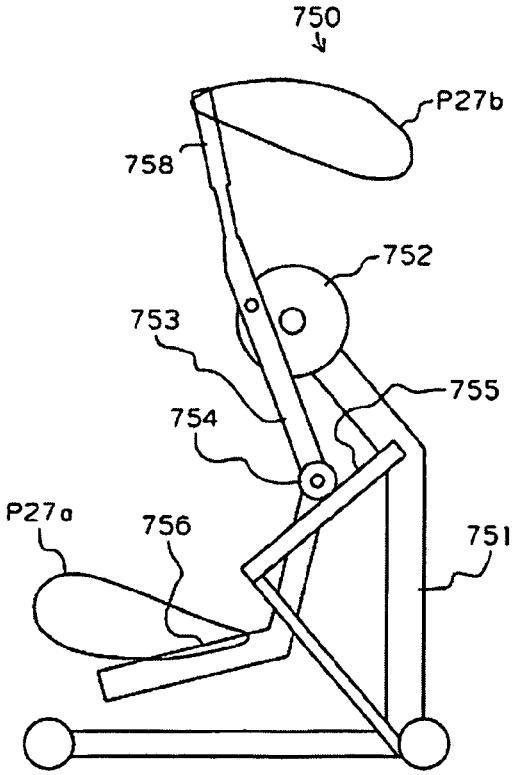

A variation of exercise apparatus 700 is designated as 750 in FIG. 37. Exercise apparatus 750 uses a roller arrangement in lieu of a rocker link to constrain a portion of each connector link to move in reciprocal fashion relative to a frame.

Exercise apparatus 750 may be generally described in terms a frame 751 designed to occupy a fixed position relative to a floor surface; left and right cranks 752 rotatably mounted on the frame 751; a ramp 755 mounted on the frame 751; and left and right connector links 753 having upper distal ends 758 which are sized and configured for grasping, relatively higher intermediate portions which are rotatably connected to radially offset portions of respective cranks 752, relatively lower intermediate portions which support respective rollers 754 that bear against the ramp 755, and lower distal ends which are connected to respective foot supporting members 756. The resulting linkage assembly links rotation of the cranks 752 to generally elliptical movement of the foot supporting members 756 and the handles 758 through respective paths P27*a* and P27*b*. The ramp 755 may be modified to be selectively movable relative to the frame 751 in order to provide different paths of exercise motion.

Figure 38:
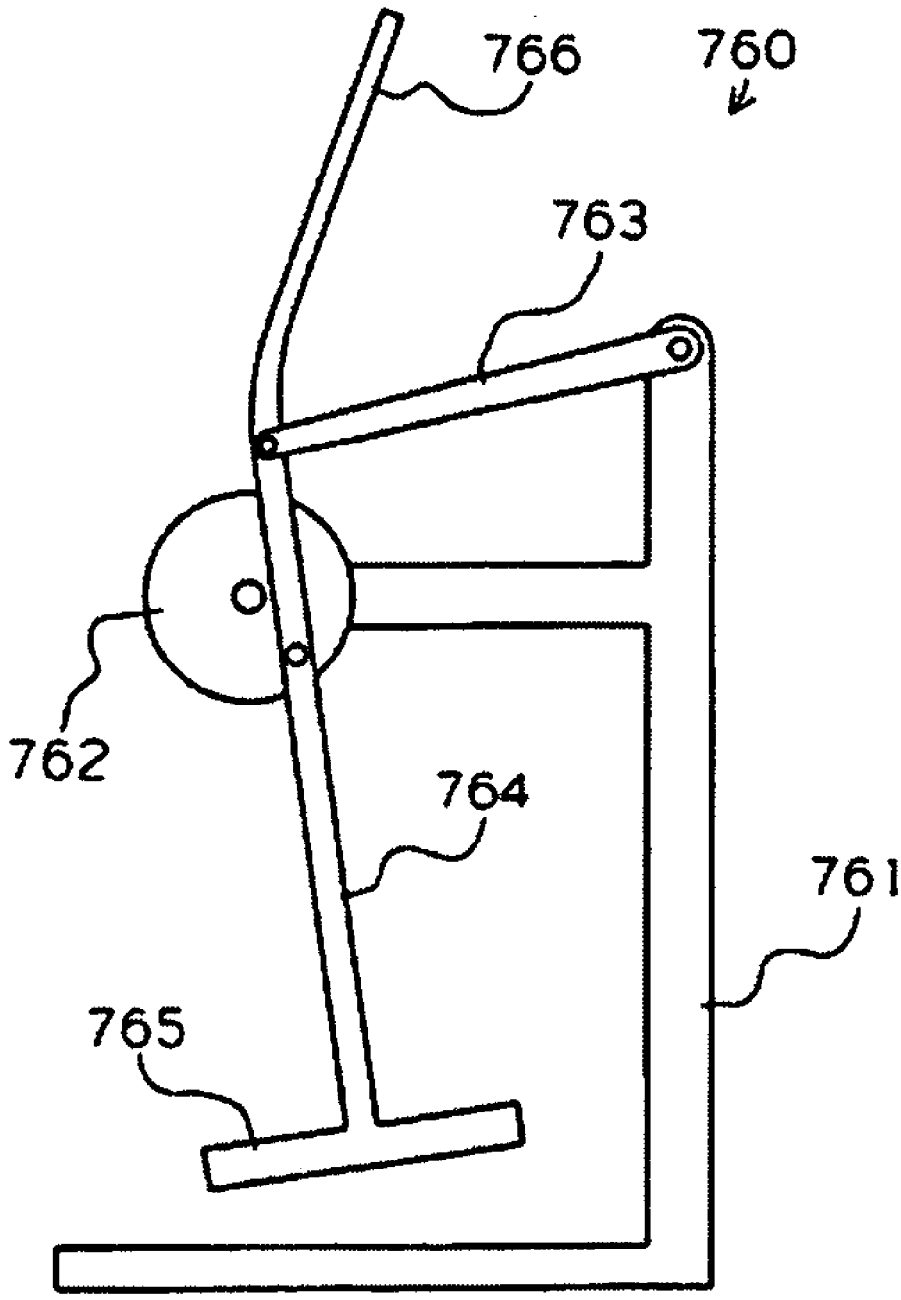

Another variation of the foregoing exercise apparatus 700 is designated as 760 in FIG. 38. Exercise apparatus 760 essentially switches the relative locations of the crank joint and the rocker joint on each connector link.

Exercise apparatus 760 may be generally described in terms a frame 761 designed to rest upon a floor surface; left and right cranks 762 rotatably mounted on the frame 761; left and right rocker links 763 rotatably connected to the frame 761; and left and right connector links 764 having lower distal end which are connected to respective foot supporting members 765, relatively lower intermediate portions which are rotatably connected to radially offset portions of respective cranks 762, relatively higher intermediate portions which are rotatably connected to distal ends of respective rocker links 763, and upper distal ends 766 which are sized and configured for grasping. The resulting linkage assembly links rotation of the cranks 762 to pivoting of the rocker links 763 and generally elliptical movement of the foot supporting members 765 and the handles 766.

Figure 39:
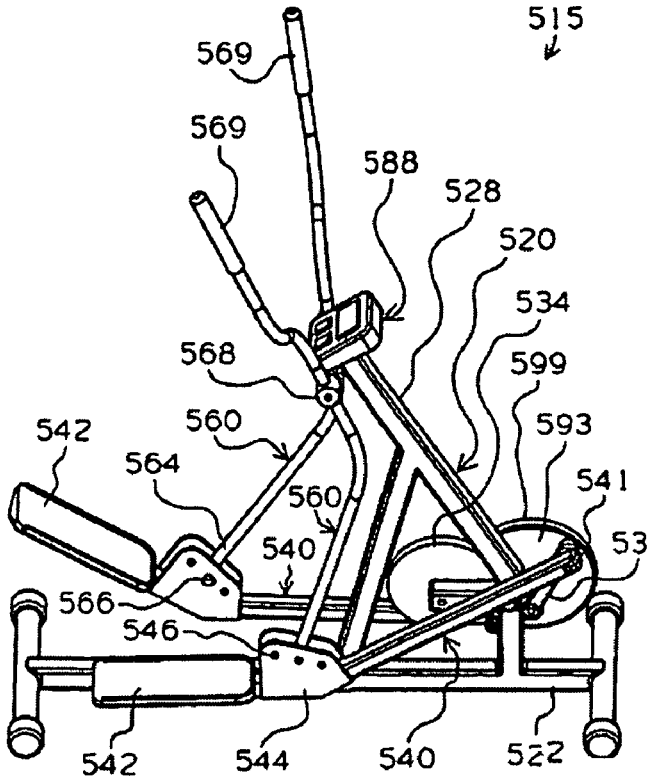
FIG. 39 is a perspective view of another exercise apparatus.
Figure 40:
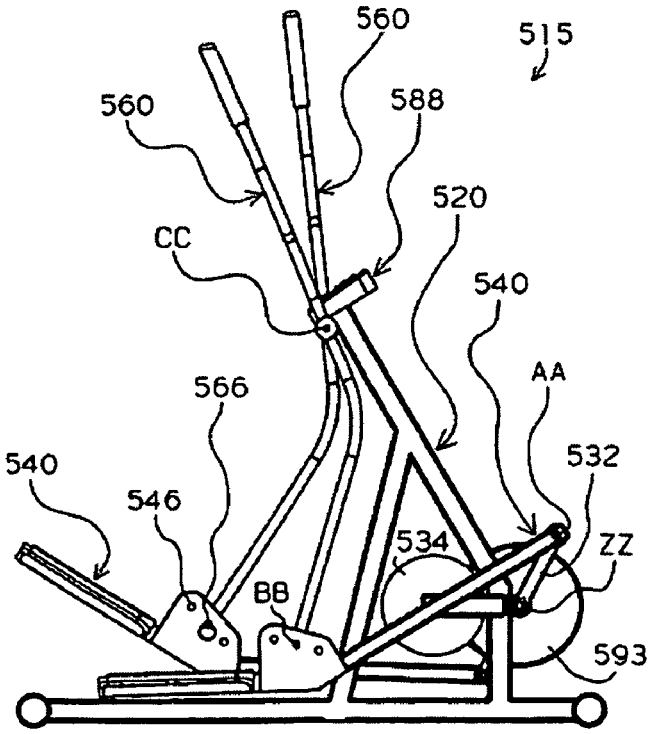
FIG. 40 is a side view of the exercise apparatus of FIG. 39.

Still another exercise apparatus constructed according to the principles of the present invention is designated as 515 in FIGS. 39-40. Exercise apparatus 515 generally includes a frame 520 and a linkage assembly movably mounted on the frame 520. Generally speaking, the linkage assembly moves relative to the frame 520 in a manner that links rotation of cranks 532 to generally elliptical motion of foot supporting, force receiving members 542.

The frame 520 includes a base 522 and a forward stanchion 528. The base 522 may be described as generally I-shaped and is designed to rest upon a horizontal floor surface. Exercise apparatus 515 is generally symmetrical about a vertical plane extending lengthwise through the base 522 (perpendicular to the transverse members at each end thereof), the only exceptions being components of a resistance assembly and the relative orientation of certain parts of the linkage assembly on opposite sides of the plane of symmetry. In exercise apparatus 515, the "right-hand" components are one hundred and eighty degrees out of phase relative to the "left-hand" components. However, like reference numerals are used to designate both the "right-hand" and "left-hand" parts on exercise apparatus 515, and when reference is made to one or more parts on only one side of exercise apparatus, it is to be understood that corresponding part(s) are disposed on the opposite side of exercise apparatus 515. Those skilled in the art will also recognize that the portions of the frame 515 which are intersected by the plane of symmetry exist individually and thus, do not have any "opposite side" counterparts.

The forward stanchion 528 may be described as an inverted y-shape which extends upward and rearward from the base 522 and supports a user accessible display 588. The display 588 is suitable for providing exercise information and/or facilitating adjustments to exercise constraints.

Crank arms 532 are rotatably mounted to the forward stanchion 528 by means known in the art and rotate about a crank axis ZZ. A flywheel 534 is also rotatably mounted to the forward stanchion 528 by means known in the art and rotates about a discrete flywheel axis. The crank arms 532 are connected to the flywheel 534 by means known in the art to provide a "stepped up" flywheel arrangement. In particular, a belt 599 is formed into a closed loop about a relatively large diameter pulley 593 secured to the crank shaft and a relative small diameter pulley secured to the flywheel shaft. As a result of this arrangement, the members 532 and 534 rotate together, but the latter rotates faster than the former.

Those skilled in the art will recognize that other known types of inertia altering mechanisms may be added to or substituted for the stepped up flywheel arrangement. For example, a drag strap or brake assembly may be provided to selectively impede rotation of the flywheel 534 and/or the crank 532. Moreover, exercise apparatus 515 could be built so that friction forces acting on the joints provide sufficient resistance to exercise movement. Those skilled in the art will also recognize that a housing or shroud may be disposed over the stepped-up crank and flywheel assembly.

First rigid links 540 are movably interconnected between the frame 520 and respective cranks 532. In particular, each link 540 has a first end or distal portion 541 which is rotatably connected to a respective crank arm 532. Each link 540 and crank arm 532 combination defines a rotational axis AA which is disposed a radial distance away from the crank axis ZZ.

Each first link 540 has an intermediate portion which is rotatably connected to a lower end 564 of a respective rocker link 560. A bracket 544 is rigidly secured to the intermediate portion of each first link 540, and several holes 546 are formed through the bracket 544. A detent pin 566 or other suitable fastener is inserted through a particular hole 546 and through an aligned bearing assembly on the lower end 564 of the rocker link 560 to rotatably interconnect the two links 560 and 540. In other words, each first link 540 and rocker link 560 combination defines a rotational axis BB which is adjustable relative to the former.

In an alternative exercise apparatus, the intermediate portion of each link 540 is rotatably connected to a respective bearing member that rocks back and forth along an underlying bearing surface. In another alternative exercise apparatus, the intermediate portion of each link 540 is rotatably connected to a respective bearing member that travels along a rail on the frame. In each case, the rotational axes defined between the links 540 and the bearing members travel in a straight line, as opposed to a relatively large radius arc on the depicted exercise apparatus 515.

Each first link 540 has an opposite, second end or distal portion which is sized and configured to support a discrete foot of a standing person. In particular, a foot platform 542 is rigidly secured to the second end of each first link 540. The bracket 544 is disposed proximate the foot platform 542 and conceals a bend in the first link 540 which places the two distal portions at an obtuse angle relative to one another.

Each rocker link 560 has an intermediate portion 568 which is rotatably connected to the forward stanchion 528. As a result, the rocker links 560 rotate about an axis CC relative to the frame 520. Each rocker link 560 has an opposite, distal portion or upper end 569 which is sized and configured for grasping by a person standing on the foot platforms 542.

Movement of either foot platform 542 causes rotation of the cranks 532 and reciprocal movement of the rockers 560. The arrangement of parts is such that the foot platforms 542 are constrained to travel through substantially elliptical paths. In other words, the links 540 and 560 may be described as a linking means, movably interconnected between the frame 520 and the cranks 532, for linking rotation of the cranks 532 to elliptical movement of the foot supports 542 and/or for linking rotation of the cranks 532 to reciprocal movement of the handles 569.

An optional feature of exercise apparatus 515 is that the orientation of the path traveled by the foot supporting members 542 may be adjusted by moving the position of the axis BB relative to the first links 540. In particular, a plurality of holes 546 are formed through adjacent flanges on each first link 540, and a lower end of each rocker link 560 is disposed between the flanges. A bearing on the rocker end 564 is aligned with any of the holes 546, and a bolt or other fastener 566 is inserted through the aligned holes to selectively interconnect the two links 540 and 560. In the alternative, the two links 540 and 560 may simply be interconnected by a fastener which is not selectively removable.

Another optional adjustment feature may be provided by selectively moving the position of the axis CC relative to the crank axis ZZ. Such an adjustment may be accomplished, for example, by making an upper portion of the forward stanchion 528 movable relative to a lower portion and using a detent pin to secure the upper portion in a plurality of positions.

A working embodiment of exercise apparatus 515 provided acceptable foot motion with the axis ZZ and the axis AA spaced approximately seven inches apart, the axis AA and the axis BB spaced approximately twenty-three inches apart, the axis BB and the axis CC spaced approximately twenty-eight inches apart, and the axis CC and the axis ZZ spaced approximately thirty inches apart. The thirty degree bend in each first link 540 provides sufficient clearance for operation relative to an underlying support surface, and the forty degree bend in each rocker link 560 provides sufficient clearance for a person's knees.

Figure 41:
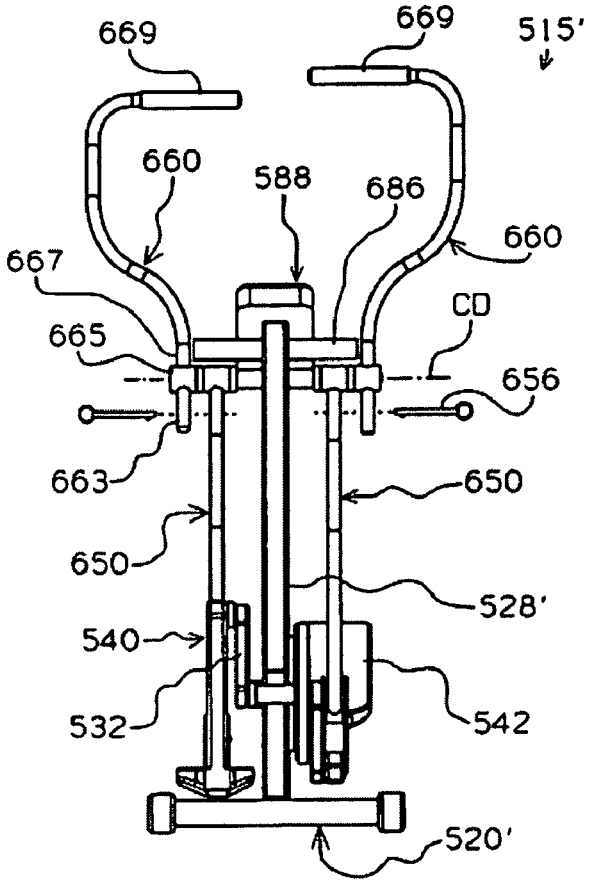
FIG. 41 is a front view of an exercise apparatus similar to that shown in FIGS. 39-40 but provided with an alternative arm exercise assembly.

An alternative embodiment arm exercise assembly is shown in FIG. 41 on an exercise apparatus 515' which is similar in all other respects to the previous embodiment 515 (as suggested by the common reference numerals). A shaft is rigidly secured to the forward stanchion 528' and protrudes beyond opposite sides thereof. Rocker links 650 have lower ends rotatably connected to respective first links 540, and upper ends rotatably mounted on opposite ends of the protruding shaft. The rocker links 650 are rotatable relative to the frame 520' about an axis CD. Arm driven members 660 have upper ends 669 sized and configured for grasping, and lower portions 665 rotatably mounted on opposite sides of the protruding shaft. The arm driven members 660 rotate about the same axis CD relative to the frame 520'.

In the absence of any additional interconnections, the arm driven members 660 and the leg driven members 650 are free to rotate relative to the frame member 520' and one another. However, pins 656 may be inserted through aligned holes in respective arm driven members 660 and leg driven members 650 (indicated generally at 663), in order to constrain them to rotate together about the axis CD. In other words, the pins 656 provide a means for selectively linking the arm driven members 660 and the leg driven members 650 and/or cooperate with the leg driven members 650 to provide a means for selectively linking the arm driven members 660 and the foot supporting members 542. In the alternative, pins 656 may be inserted through aligned holes in respective arm driven members 660 and a frame member 686 (indicated generally at 667), in order to lock the former in place relative to the latter. In this configuration, the leg driven members 650 remain free to rotate relative to both the frame 520' and the arm driven members 660. In other words, the pins 656 also provide a means for selectively locking the arm driven members 660 to the frame 520'.

Exercise apparatus 515' provides the options of stationary arm supports, independent arm and leg exercise members, and dependent arm and leg exercise members. A resistance device which, for example, may include friction pads and thrust bearings, may be provided to resist movement of the arm driven members 660 independent of the leg driven members 650.

Figure 42:
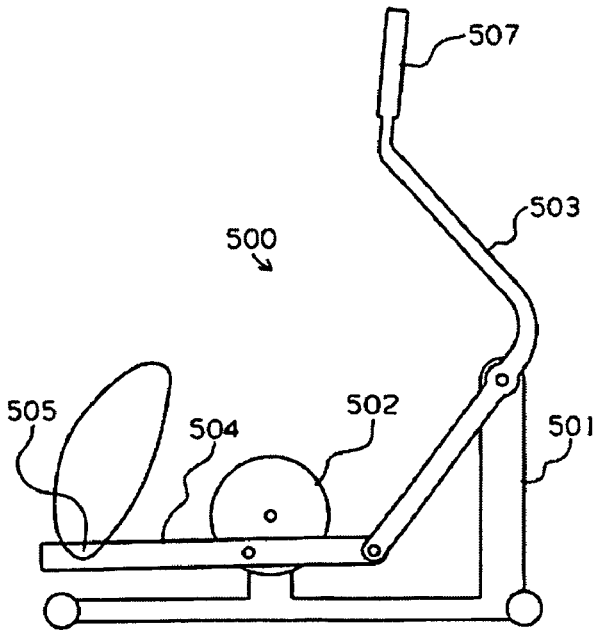
FIG. 42 is a side view of an exercise apparatus similar in many respects to the exercise apparatuses of FIGS. 39-40.

A variation of the foregoing exercise apparatus 515 is designated as 500 in FIG. 42. Exercise apparatus 500 essentially switches the relative locations of the crank joint and the rocker joint on each of the foot supporting links, as compared to the previous embodiments 515 and 515'.

Exercise apparatus 500 may be generally described in terms a frame 501 designed to occupy a fixed position relative to a floor surface; left and right cranks 502 rotatably mounted on the frame 501; left and right rocker links 503 rotatably connected to the frame 501; and left and right connector links 504 having rearward distal ends which are connected to respective foot supporting members 505, intermediate portions which are rotatably connected to radially offset portions of respective cranks 502, and forward distal ends which are rotatably-connected to lower distal ends of respective rocker links 503. Upper distal ends 507 of the rocker links 503 are sized and configured for grasping. The resulting linkage assembly links rotation of the cranks 502 to pivoting of the rocker links 503 and handles 507 and generally elliptical movement of the foot supporting members 505.

Figure 43:
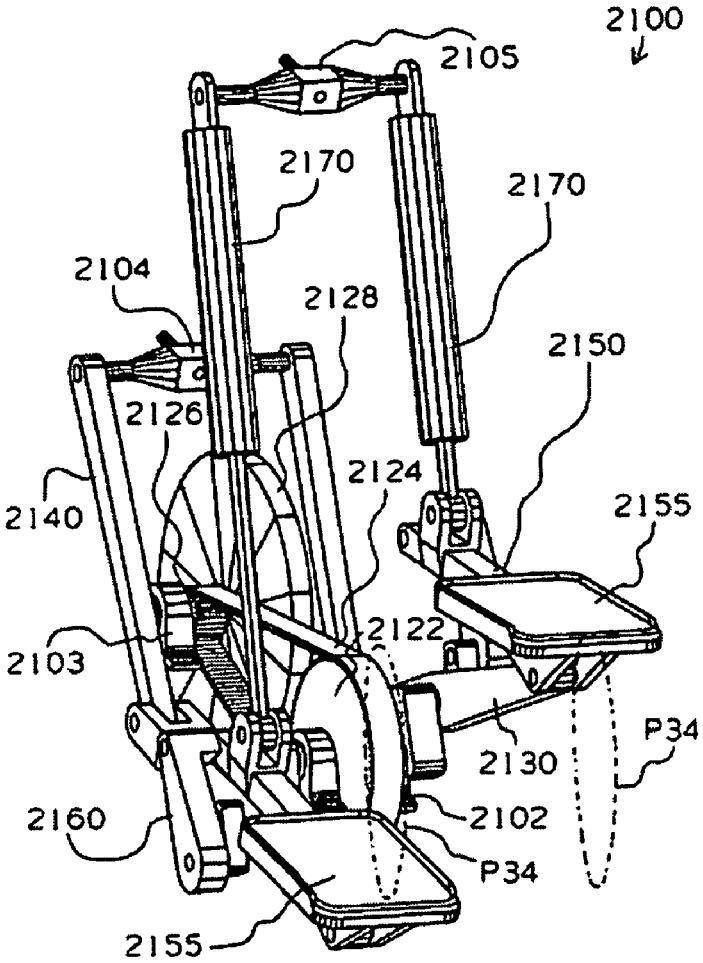
FIG. 43 is a perspective view of another exercise.
Figure 44:
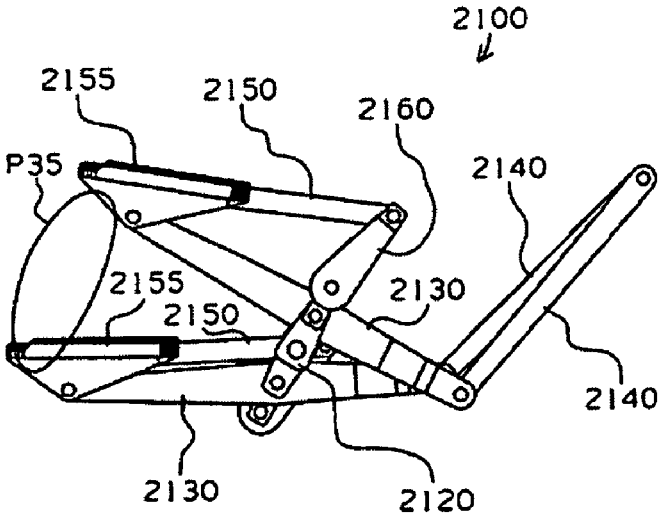
FIG. 44 is a side view of a portion of the exercise apparatus of FIG. 43, FIG. 45-47 are side views of other exercise apparatus.

FIGS. 43-44 show a "stepping" type exerciser 2100 constructed according to the principles of the present invention. Exercise apparatus 2100 includes left and right cranks 2120 rotatably connected to a frame by means of a crank shaft and bearing assemblies 2102. A larger diameter pulley 2122 is keyed to the crank shaft and rotates together with the cranks 2120 about a common crank axis. A belt 2124 connects the pulley 2122 to a smaller diameter pulley 2126 which is rigidly secured to a flywheel 2128. The pulley 2126 and the flywheel 2128 are rotatably connected to the frame by means of a flywheel shaft and bearing assemblies 2103. As a result, the pulley 2126 and the flywheel 2128 rotate at a relative faster rotational velocity than the cranks 2120 and pulley 2122. A conventional resistance device may be connected to the flywheel 2128 to resist rotation thereof.

Left and right connector links 2130 have intermediate portions which are rotatably connected to radially displaced portions of respective cranks 2120. The connector links 2130 have first ends which are rotatably connected to first ends of respective rocker links 2140, and second, opposite ends which are connected to respective foot supporting members 2150. The rocker links 2140 have second, opposite ends which are rotatably connected to the frame by means of frame member 2104.

One end of each foot supporting member 2150 is rotatably connected to a respective connector link 2130, and an opposite end of each foot supporting member 2150 is rotatably connected to an end of a respective floating crank 2160. An opposite end of each floating crank 2160 is rotatably connected to a distal end of a respective crank 2120. Left and right foot platforms 2155 are mounted on respective foot supporting members 2150 proximate their pivotal connections with respective connector links 2130. The floating cranks 2160 and pivoting foot supporting members 2150 cooperate to maintain the foot platforms 2155 in relatively favorable orientations throughout an exercise cycle.

Optional left and right dampers 2170 are rotatably interconnected between frame member 2105 and intermediate portions of respective foot supporting members 2150. The arrangement is such that the dampers 2170 tend to resist vertical movement of the foot platforms 2155 without unduly interfering with "over center" rotation of the cranks 2120.

Figure 45:
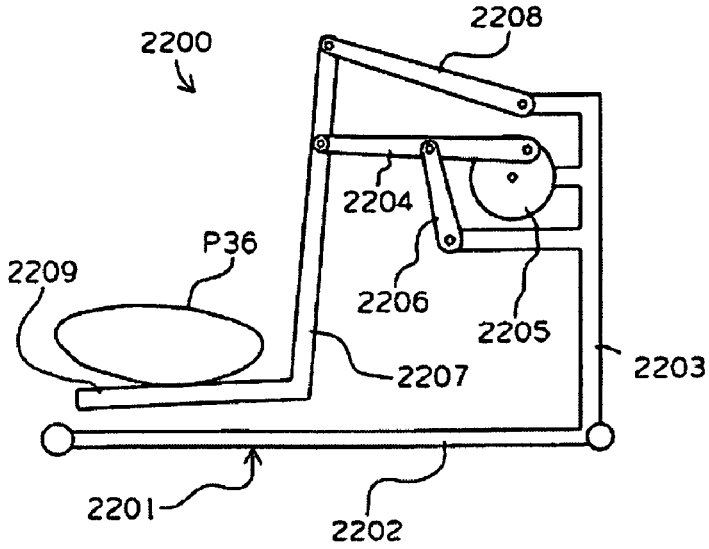

Yet another exercise apparatus that can be adapted to employ the present invention is designated as 2200 in FIG. 45. Exercise apparatus 2200 includes a frame 2201 having a base 2202 designed to occupy a fixed position relative to a floor surface, and a stanchion 2203 extending upward from an end of the base 2202. Left and right connector links 2204 have (a) first ends rotatably connected to respective cranks 2205, which in turn, are rotatably mounted on opposite sides of the stanchion 2203; (b) intermediate portions rotatably connected to respective rocker links 2206, which in turn, are rotatably connected to opposite sides of the stanchion 2203; and (c) second, opposite ends rotatably connected to intermediate portions of respective foot supporting members 2207. Upper ends of the foot supporting members 2207 are rotatably connected to respective rocker links 2208, which in turn, are rotatably connected to opposite sides of the stanchion 2203 (above the cranks 2205). The lower end 2209 of each foot supporting members 2207 is sized and configured to support a respective foot of a standing person.

The foot supports 2209, rocker links 2208, and connector links 2204 extend substantially parallel to an underlying floor surface, and the foot supporting members 2207 and rocker links 2206 extend substantially perpendicular to the underlying floor surface. The resulting linkage assembly links rotation of the cranks 2205 to generally elliptical movement of the foot supports 2209 through the path designated as P36.

Figure 46:
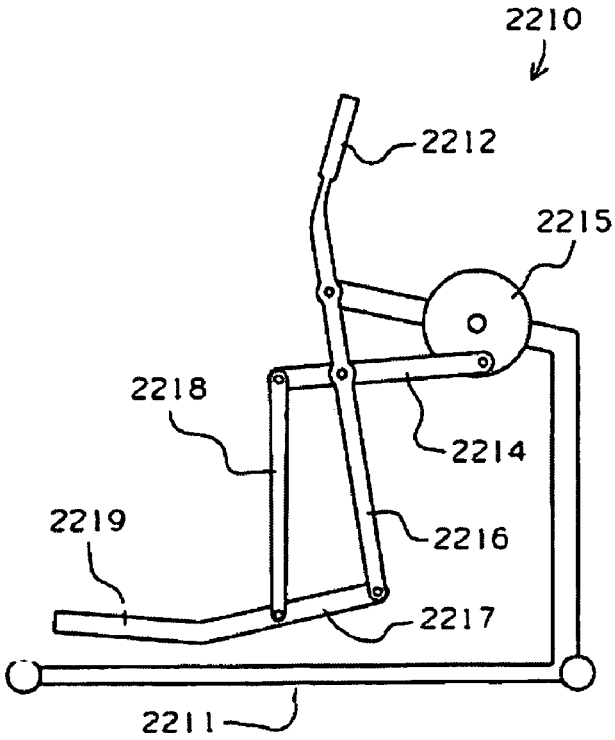

Still another exercise apparatus that can be adapted to employ the present invention is designated as 2210 in FIG. 46. Exercise apparatus 2210 includes a frame 2211 having a base designed to occupy a fixed position relative to a floor surface, and a stanchion extending upward from an end of the base. Left and right connector links 2214 have (a) first ends rotatably connected to respective cranks 2215, which in turn, are rotatably mounted on opposite sides of the stanchion; (b) intermediate portions rotatably connected to respective rocker links 2216, which in turn, are rotatably connected to opposite sides of the stanchion; and (c) second, opposite ends rotatably connected to upper ends of respective intermediate links 2218. Opposite, lower ends of the intermediate links

2218 are rotatably connected to intermediate portions of respective foot supporting links 2217.

Each rocker link 2216 has (a) a lower end rotatably connected to a forward end of a respective foot supporting link 2217; (b) a relatively lower intermediate portion rotatably connected to a respective connector link 2214; (c) a relatively higher intermediate portion rotatably connected to the stanchion; and (d) an upper end 2212 sized and configured for grasping. A rearward end 2219 of each foot supporting link 2217 is sized and configured to support a respective foot of a standing person.

The foot supporting links 2219 and connector links 2214 extend substantially parallel to an underlying floor surface, and the intermediate links 2218 and rocker links 2216 extend substantially perpendicular to the underlying floor surface. The resulting linkage assembly links rotation of the cranks 2215 to generally elliptical movement of the foot supports 2219.

Figure 47:
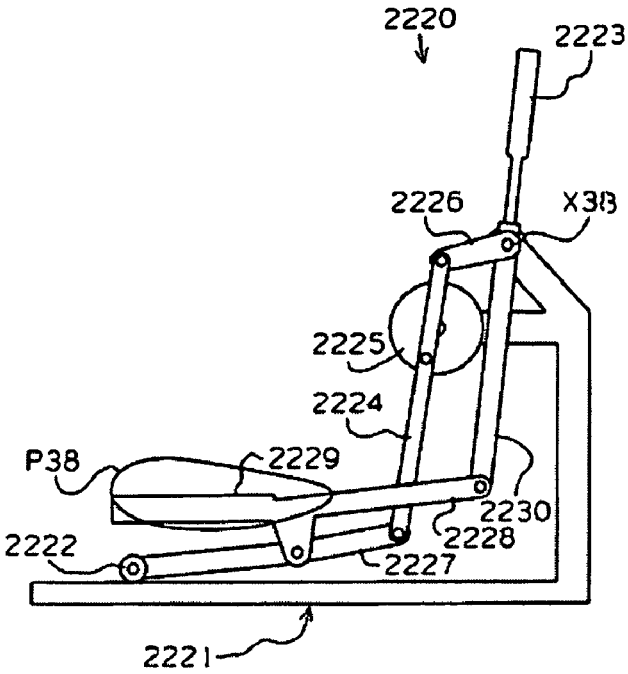

In FIG. 47, another variation of the present invention is designated as 2220. Exercise apparatus 2220 includes a frame 2221 having a base designed to occupy a fixed position relative to a floor surface, and a stanchion extending upward from an end of the base. Left and right connector links 2224 have (a) first ends rotatably connected to respective rocker links 2226, which in turn, are rotatably connected to opposite sides of the stanchion; (b) intermediate portions rotatably connected to respective cranks 2225, which in turn, are rotatably mounted on opposite sides of the stanchion; and (c) second, opposite ends rotatably connected to forward ends of respective rolling links 2227.

Left and right rollers 2222 are rotatably mounted on rearward ends of respective rolling links 2227 and bear against underlying surfaces on the frame 2221. Left and right foot supporting members 2228 have intermediate portions which are rotatably connected to intermediate portions of respective roller links 2227. A rearward end 2229 of each foot supporting member 2228 is sized and configured to support a respective foot of a standing person. An opposite, forward end of each foot supporting member 2228 is rotatably connected to a lower end of a respective rocker link 2230. An intermediate portion of each rocker link 2230 is rotatably connected to the stanchion, and an upper end 2233 of each rocker link 2230 is sized and configured for grasping.

The foot supporting members 2228, rolling links 2227, and rocker links 2226 extend substantially parallel to an underlying floor surface, and the connector links 2224 and rocker links 2230 extend substantially perpendicular to the underlying floor surface. Also, the rocker links 2230 and the rocker links 2226 share a common pivot axis X38 relative to the stanchion. The resulting linkage assembly links rotation of the cranks 2225 to generally elliptical movement of the foot supports 2229 through the path designated as P38.

Figure 48:
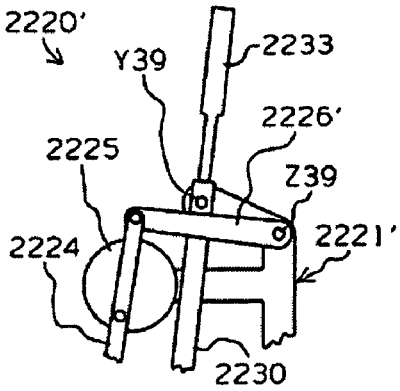
FIG. 48 is a side view of an alternative linkage arrangement suitable for use on the exercise apparatus of FIG. 47.

FIG. 48 shows an alternative exercise apparatus 2200' which is similar in many respects to exercise apparatus 2200. However, distinct rocker links 2226' cooperate with a distinct frame 2221' to define a pivot axis Z39 which is spaced apart from the pivot axis Y39 defined between the frame 2221' and the other rocker links 2230.

Figure 49:
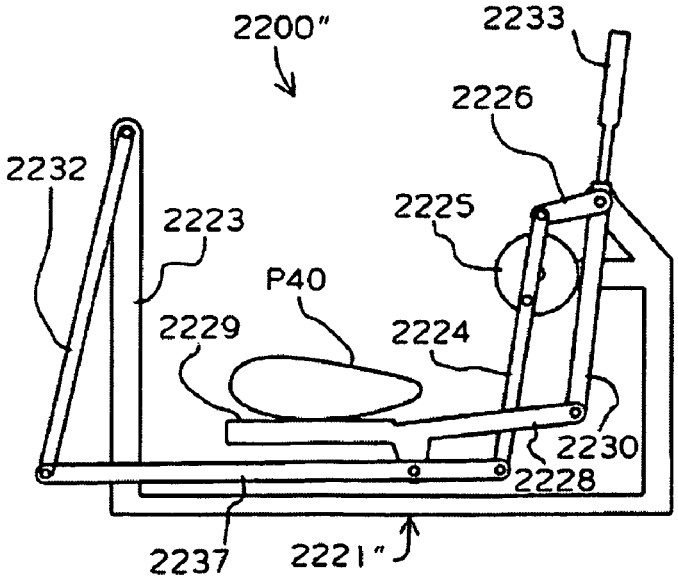
FIG. 49 is a side view of an exercise apparatus similar in many respects to the exercise apparatus of FIG. 48.

FIG. 49 shows another exercise apparatus 2200" than can be adapted to employ the present invention which is similar in many respects to the foregoing exercise apparatus 2200. However, swinging links 2237 are substituted for the rolling links 2227, and left and right rocker links 2232 are rotatably connected between respective swinging links 2237 and a rearward stanchion 2223 on the frame 2221". The resulting linkage assembly links rotation of the cranks 2225 to generally elliptical movement of the foot supports 2229 through the path designated as P40.

Figure 50:
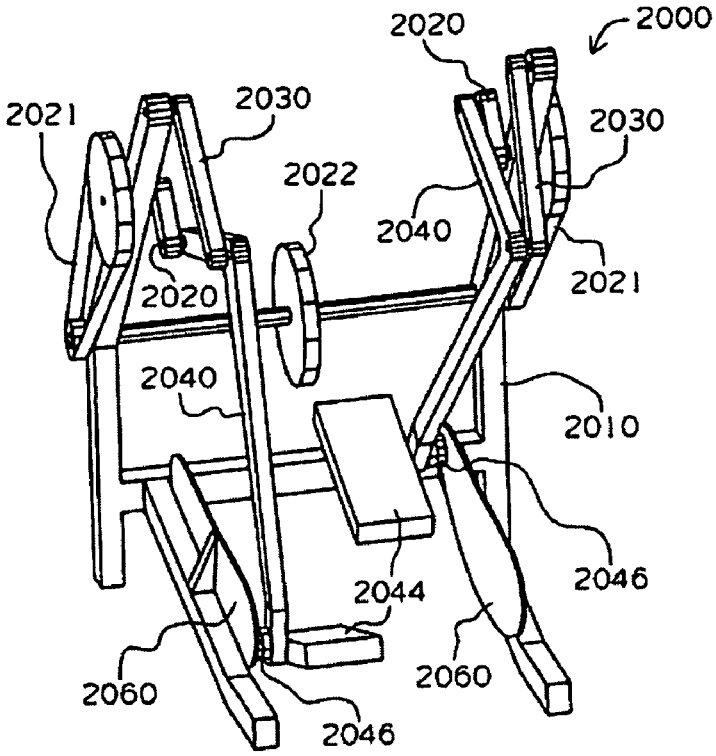
FIG. 50 is a perspective view of another exercise apparatus.
Figure 51:
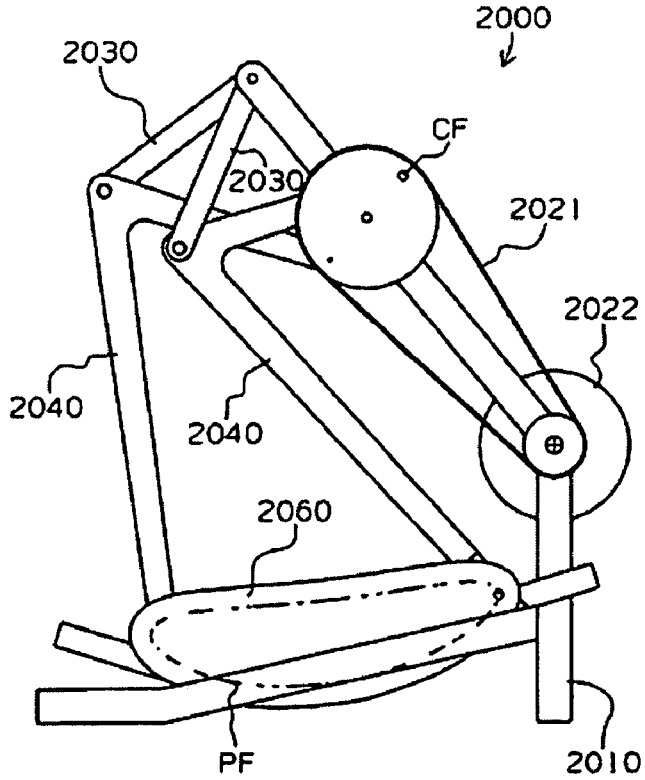
FIG. 51 is a side view of the exercise apparatus of FIG. 50.

Another aspect of the present invention is described with reference to an exercise apparatus designated as 2000 in FIGS. 50-51. Exercise apparatus 2000 includes a frame 2010 designed to occupy a fixed position relative to a horizontal floor surface. Left and right cranks 2020 are rotatably mounted on opposite sides of the frame 2010 and synchronized to rotate together with a flywheel shaft by means of pulleys and belts 2021 disposed on each side of the frame 2010. The pulleys and belts 2021 interconnect the cranks 2020 in a manner which causes the flywheel shaft and flywheel 2022 to rotate in "stepped-up" fashion relative thereto.

Connector links 2040 have first connection points which are rotatably connected to radially offset portions of respective cranks 2020 (see CF in FIG. 51), and second connection points which are rotatably connected to distal ends of respective rocker links 2030. Opposite ends of the rocker links 2030 are rotatably connected to opposite sides of the frame 2010. Foot supporting platforms 2044 are connected to third connection points on respective connector links 2040. The three connection points on each connector link 2040 cooperate to define the vertices of a triangle. The connector links 2040 need not span all three sides of the triangle in order to effect all of the necessary connections. On exercise apparatus 2000, the connector links 2040 extend from the third connection points to the second connection points and then to the first connection points. In other words, the connector links 2040 do not extend directly between the first connection points and the third connection points but could do so without departing from the scope of the present invention.

The above-described arrangement of components is such that rotation of the cranks 2020 is linked to movement of the foot supports 2044 through generally elliptical paths of motion designated as PF. Rigid plates 2060, which are sized and configured to cover or span the paths of motion PF, are rigidly secured to opposite sides of the frame 2010, just outside respective paths of motion PF. Bearing members 2046 project laterally from respective foot supports 2044 and bear against respective plates 2060. The bearing members 2046 and plates 2060 are manufactured to facilitate movement of the former across the latter. An advantage of this arrangement is a reduction in side loading forces acting on the rotational joints.

Figure 52:
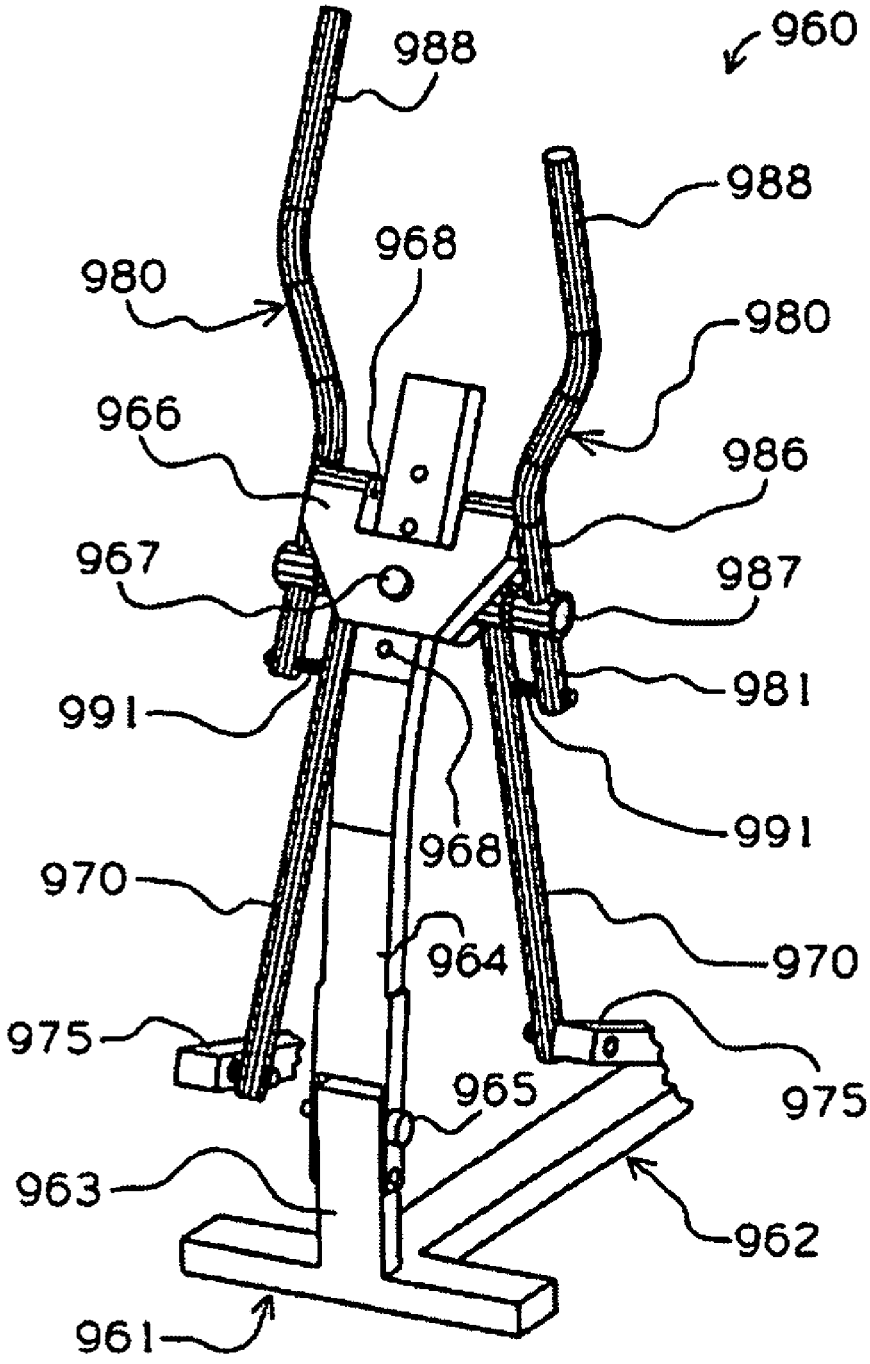
FIG. 52 is a perspective view of an arm exercise assembly suitable for use on some embodiments of the present invention.

Another variation of the present invention may be described with reference to an arm exercise assembly designated as 960 in FIG. 52. The assembly 960 is shown relative to a frame 961 having a base 962 that is designed to rest upon a floor surface. A stanchion or upright 963 extends upward from the base 962 proximate the front end of the frame 961. A post 964 is pivotally mounted on the upright 963 and selectively secured in a generally vertical orientation by means of a ball detent pin 965. The pin 965 may be removed in order to pivot the post 964 to a collapsed or storage position relative to the base 962.

Another frame member or yoke 966 is slidably mounted on the post 964, between an upper distal end of the post 964 and a pair of outwardly extending shoulders near the lower, pivoting end. A spring-loaded pin 967 (or other suitable fastener) extends through the frame member 966 and into any of a plurality of holes 968 in the post 964 to selectively lock the frame member 966 at one of a plurality of positions along the post 964 (and above the underlying floor surface).

Left and right vertical members or rocker links 970 have upper ends which are rotatably mounted to opposite sides of a shaft 987 on the frame member 966. Opposite, lower ends of the links 970 are rotatably connected to forward ends of respective foot supporting members 975. The rearward portions of the foot supporting members 975, as well as the remainder of the linkage assembly components, are comparable to those on exercise apparatus 800, for example. The inclination of the path traveled by the foot supporting members 975 is a function of the height of the frame member 966 above the floor surface. In other words, the difficulty of exercise can be increased simply by locking the frame member 966 in a relatively higher position on the post 964.

Left and right handle members 980 are also rotatably connected to opposite ends of the shaft 987 on the frame member 966 and thus, share a common pivot axis with the links 970. The handle members 980 include upper, distal portions 988 which are sized and configured for grasping by a person standing on the foot supporting members 975. A hole is formed through each handle member 980, proximate its lower end 981 (and beneath the pivot axis), and a corresponding hole is formed through each link 970 at an equal radial distance away from the pivot axis.

Pins 991 are selectively inserted through the aligned holes to interconnect respective links 970 and handle members 980 and thereby constrain each pinned combination to pivot as a unit about the pivot axis. In this particular configuration, the pins 991 may be said to be selectively interconnected between respective handle members 980 and links 970, and/or to provide a means for selectively linking respective handle members 980 and links 970. Moreover, the pins 991 may be seen to cooperate with the links 970 to provide a means for selectively linking the handle members 980 to respective foot supporting members 975.

Another hole 986 is formed through each of the handle members 980, above the pivot axis, and corresponding holes 968 are formed in the frame member 966 at an equal radial distance above the pivot axis. The same pins 991 may alternatively be inserted through the aligned holes 986 and 968 to interconnect the handle members 980 and the frame member 966 and thereby lock the former in place relative to the latter. In this configuration, the pins 991 may be seen to provide a means for selectively locking the handle members 980 (but not the links 970) to the frame 961. In the absence of any such pin connections, the handle members 980 and the links 970 are free to pivot relative to the frame 961 and one another.

The foregoing embodiments and associated methods are representative but not exhaustive examples of exercise apparatuses than can be adapted to employ the present invention. It is to be understood that the embodiments and/or their respective features may be mixed and matched in a variety of ways to arrive at other embodiments. For example, the control and/or display options described with reference to a particular embodiment are applicable to other embodiments, as well. Recognizing that this disclosure will lead those skilled in the art to recognize additional embodiments, modifications, and/or applications which fall within the scope of the present invention, the scope of the present invention is to be limited only to the extent of the claims which follow.

The invention claimed is:

1. An exercise apparatus for exercising a user's arms and legs comprising:

a frame for residing on a horizontal surface;

a pair of arm-supporting members for supporting the user's arms;

a pair of leg-supporting members for supporting the user's legs;

a linkage assembly for coupling the arm-supporting members and leg-supporting members to the frame and for moving the arm-supporting members and leg-supporting members in closed paths relative to the frame in response to forces the user applies to the arm-supporting members and leg-supporting members, wherein the linkage assembly comprises at least one actuator, each actuator for adjusting a dimension of at least one of the closed paths in response to a control signal;

a sensor coupled to the linkage assembly for generating a force-indicating signal representing a user force applied to at least one of the arm-supporting and leg-supporting members; and a user interface for receiving the force-indicating signal, generating the control signal from the force-indicating signal, and supplying the control signal to each actuator.

2. The exercise apparatus in accordance with claim 1 wherein the closed paths of the leg-supporting members have non-zero dimensions along two perpendicular axes and the at least one actuator adjusts dimensions of the closed paths of the leg-supporting members along at least one of the two perpendicular axes.

3. The exercise apparatus in accordance with claim 1 wherein the closed paths of each leg-supporting member have non-zero dimensions along two perpendicular axes, and wherein the at least one actuator adjusts dimensions of the closed paths of the leg-supporting members along each of the two perpendicular axes.

4. The exercise apparatus in accordance with claim 1 wherein a dimension of at least one of the closed paths is a function of at least one of the forces applied to the leg and arm-supporting members.

5. The exercise apparatus in accordance with claim 1 wherein the at least one actuator adjusts a dimension of the closed paths of the leg-supporting members.

6. The exercise apparatus in accordance with claim 1 wherein the sensor senses the user force applied to at least one of the arm-supporting members.

7. The exercise apparatus in accordance with claim 1 wherein the sensor comprises a strain gauge.

8. The exercise apparatus in accordance with claim 1 wherein the linkage assembly interconnects the arm-supporting members and leg-supporting members such that movement of the arm-supporting members is synchronized to movement of the leg-supporting until the user applies a threshold amount of force to the arm-supporting member, in which case, movement of the arm-supporting members deviate from their otherwise synchronized movement relative to the leg-supporting members.

9. The exercise apparatus in accordance with claim 1 further comprising;

a resistance device coupled to the frame and to the linkage assembly for providing an adjustable resistance to movement of the leg and arm-supporting members in the closed paths.

10. The exercise apparatus in accordance with claim 9 wherein the user interface adjusts the adjustable resistance provided by the resistance device in response to the force-indicating signal.

11. The exercise apparatus in accordance with claim 9 wherein the resistance device provides separate resistance to movement of the leg and arm-supporting members along their respective paths.

12. A method for exercising a user's arms and legs comprising the steps of:

a. providing a pair of arm-supporting members for supporting the user's arms;

b. providing a pair of leg-supporting members for supporting the user's legs;

c. linking the arm-supporting members and leg-supporting members to a frame so that they move in closed paths relative to the frame in response to forces the user applies to the arm-supporting members and leg-supporting members;

d. adjusting a dimension of at least one of the closed paths in response to a control signal;

e. generating a force-indicating signal representing a user force applied to at least one of arm-supporting and leg-supporting members; and f. providing a user interface for receiving the force-indicating signal and for generating the control signal from the force-indicating signal.

13. The method in accordance with claim 12 wherein the closed paths of the leg-supporting members have non-zero dimensions along two perpendicular axes and step d comprises adjusting dimensions of the closed paths of the leg-supporting members along at least one of the two perpendicular axes.

14. The method in accordance with claim 12 wherein the closed paths of the leg-supporting members have non-zero dimensions along two perpendicular axes and wherein step d comprises adjusting dimensions of the closed paths of the leg-supporting members along each of the two perpendicular axes.

15. The method in accordance with claim 12 wherein a dimension of at least one of the closed paths is a function of at least one of the forces applied to the leg and arm-supporting members.

16. The method in accordance with claim 12 wherein step d comprises adjusting a dimension of the closed paths of the leg-supporting members is adjusted in response to the control signal.

17. The method in accordance with claim 12 wherein step e comprises sensing user forces applied to at least one of the arm-supporting members and generating the force-indicating signal in response to the sensed user forces.

18. The method in accordance with claim 12 wherein step c comprising linking the arm-supporting members and leg-supporting members such that movement of the arm-supporting members is synchronized to movement of the leg-supporting until the user applies a threshold amount of force to the arm-supporting member, in which case, the arm-supporting members deviate from their synchronized movement relative to the leg-supporting members.

19. The method in accordance with claim 12 further comprising the step of g. providing an adjustable resistance to movement of the leg and arm-supporting members in the closed paths.

20. The method in accordance with claim 19 further comprising the step of:

g. adjusting the adjustable resistance provided by the resistance device in response to the force-indicating signal.

* * * * *

UNITED STATES PATENT AND TRADEMARK OFFICE

CERTIFICATE OF CORRECTION

PATENT NO. : 7,824,314 B2
APPLICATION NO. : 12/397942
DATED : November 2, 2010
INVENTOR(S) : Joseph D. Maresh It is certified that error appears in the above-identified patent and that said Letters Patent is hereby corrected as shown below:

The subparagraph at column 34, lines 7-10 (claim 1, lines 17-20) should read:
--a sensor coupled to the linkage assembly for measuring a variable user force applied to at least one of the arm-supporting and leg-supporting members and generating a corresponding variable force-indicating signal; and--.

Column 35, line 1, (claim 12, line 7),
--providing a linkage assembly for-- should be inserted before “linking”.

The subparagraph at column 35, lines 8-10 (claim 12, lines 14-16) should read:
--e. providing a sensor coupled to the linkage assembly for measuring a variable user force applied to at least one of arm-supporting and leg-supporting members and generating a corresponding variable force-indicating signal; and--.

Signed and Sealed this
Twenty-sixth Day of June, 2012

David J. Kappos

David J. Kappos
*Director of the United States Patent and Trademark Office*